US010514646B2

(12) United States Patent
Narita et al.

(10) Patent No.: US 10,514,646 B2
(45) Date of Patent: Dec. 24, 2019

(54) IMAGE FORMING APPARATUS AND IMAGE FORMING METHOD

(71) Applicants: Susumu Narita, Tokyo (JP); Yoshinobu Sakaue, Kanagawa (JP); Ryo Sato, Tokyo (JP); Koichi Murota, Tokyo (JP); Masashi Suzuki, Saitama (JP); Takuma Nishio, Kanagawa (JP); Hiroaki Nishina, Tokyo (JP)

(72) Inventors: Susumu Narita, Tokyo (JP); Yoshinobu Sakaue, Kanagawa (JP); Ryo Sato, Tokyo (JP); Koichi Murota, Tokyo (JP); Masashi Suzuki, Saitama (JP); Takuma Nishio, Kanagawa (JP); Hiroaki Nishina, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/990,317

(22) Filed: May 25, 2018

(65) Prior Publication Data

US 2018/0356759 A1 Dec. 13, 2018

(30) Foreign Application Priority Data

Jun. 13, 2017 (JP) ..... 2017-116141

(51) Int. Cl.
*G03G 15/00* (2006.01)
*G03G 15/043* (2006.01)

(52) U.S. Cl.
CPC ..... *G03G 15/5062* (2013.01); *G03G 15/043* (2013.01); *G03G 15/6529* (2013.01); *G03G 2215/00042* (2013.01)

(58) Field of Classification Search
CPC ..... G03G 15/5062; G03G 15/043; G03G 15/6529
See application file for complete search history.

(56) References Cited

U.S. PATENT DOCUMENTS 7,228,083 B2 * 6/2007 Iwakawa ..... G03G 15/5062 399/15
9,778,610 B2 * 10/2017 Hiroi ..... G03G 15/5062
(Continued)

FOREIGN PATENT DOCUMENTS

JP 2007-156192 6/2007
JP 2015-085525 5/2015

OTHER PUBLICATIONS

Machine translation into English of JP 2015-085525 (Year: 2015).*

*Primary Examiner* — Walter L Lindsay, Jr.
*Assistant Examiner* — Arlene Heredia
(74) *Attorney, Agent, or Firm* — Duft & Bornsen, PC

(57) ABSTRACT

An image forming apparatus includes a latent image bearer, a latent image writing device, a developing device, a conveyance unit to convey a recording medium, a transfer device, a length data acquisition unit to obtain a length of the recording medium in a conveyance direction of the recording medium, an image forming processor to form a test pattern, and a light quantity correction calculator that acquires image density data of the test pattern and calculates a light quantity correction value to correct a light quantity. The image forming processor sets a position of the test pattern on the recording medium in the conveyance direction of the recording medium and a length of the test pattern in the conveyance direction of the recording medium based on the length of the recording medium in the conveyance direction of the recording medium obtained by the length data acquisition unit.

11 Claims, 22 Drawing Sheets

(56) References Cited

U.S. PATENT DOCUMENTS

| | | | | |
|---|---|---|---|---|
| 9,939,767 | B2 * | 4/2018 | Nishino | B65H 1/00 |
| 2017/0199488 | A1 * | 7/2017 | Maeda | G03G 15/5062 |
| 2017/0371292 | A1 | 12/2017 | Narita et al. | |

* cited by examiner

IMAGE FORMING APPARATUS AND IMAGE FORMING METHOD

CROSS-REFERENCE TO RELATED APPLICATION

This patent application is based on and claims priority pursuant to 35 U.S.C. § 119 to Japanese Patent Application No. 2017-116141, filed on Jun. 13, 2017 in the Japanese Patent Office, the entire disclosure of which is hereby incorporated by reference herein.

BACKGROUND

Technical Field

The present disclosure relates to an image forming apparatus and image forming method.

Background Art

Conventionally, image forming apparatuses include a latent image forming device to irradiate a surface of a latent image bearer with light and form a latent image on the latent image bearer, a developing device to develop the latent image, a transfer device to transfer the image developed by the developing device onto a recording medium conveyed by a conveyance unit, and a light quantity correction calculator. The light quantity correction calculator acquires image density data of a test pattern formed on the recording medium and calculates a light quantity correction value to correct light quantity based on the acquired image density data.

Some image forming apparatuses read the test pattern formed on a sheet using a scanner, obtain the light quantity correction value based on the image density of the test pattern read by the scanner, control driving each LED of a LED array as the latent image forming device based on the obtained light quantity correction value to correct image density unevenness in the main scanning direction that is the alignment direction of the LEDs.

SUMMARY

This specification describes an improved image forming apparatus.

In one illustrative embodiment, the image forming apparatus includes a latent image bearer, a latent image writing device that exposes a surface of the latent image bearer to form a latent image on the latent image bearer, a developing device to develop the latent image, a conveyance unit to convey a recording medium, a transfer device to transfer an image developed by the developing device from the latent image bearer onto the recording medium, a length data acquisition unit to obtain a length of the recording medium in a conveyance direction of the recording medium set in the image forming apparatus, an image forming processor to form a test pattern, and a light quantity correction calculator. The image forming processor sets a position of the test pattern on the recording medium in the conveyance direction of the recording medium and a length of the test pattern in the conveyance direction of the recording medium based on the length of the recording medium in the conveyance direction of the recording medium obtained by the length data acquisition unit. The light quantity correction calculator acquires image density data of the test pattern formed on the recording medium and calculates a light quantity correction value to correct a light quantity with which the latent image writing device exposes the surface of the latent image bearer based on the acquired image density data.

In another embodiment, an image forming method includes obtaining a length of a recording medium in a conveyance direction of a recording medium set in the image forming apparatus that forms a test pattern on the recording medium, setting a position of the test pattern and a test pattern length in the conveyance direction of the recording medium based on the obtained length of the recording medium in the conveyance direction of the recording medium, forming the test pattern based on the position of the test pattern and the test pattern length in the conveyance direction of the recording medium, acquiring image density data of the test pattern formed on the recording medium, calculating a light quantity correction value to correct a light quantity of the image forming apparatus based on the image density data acquired, and forming an image using the light quantity corrected by the light quantity correction value.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
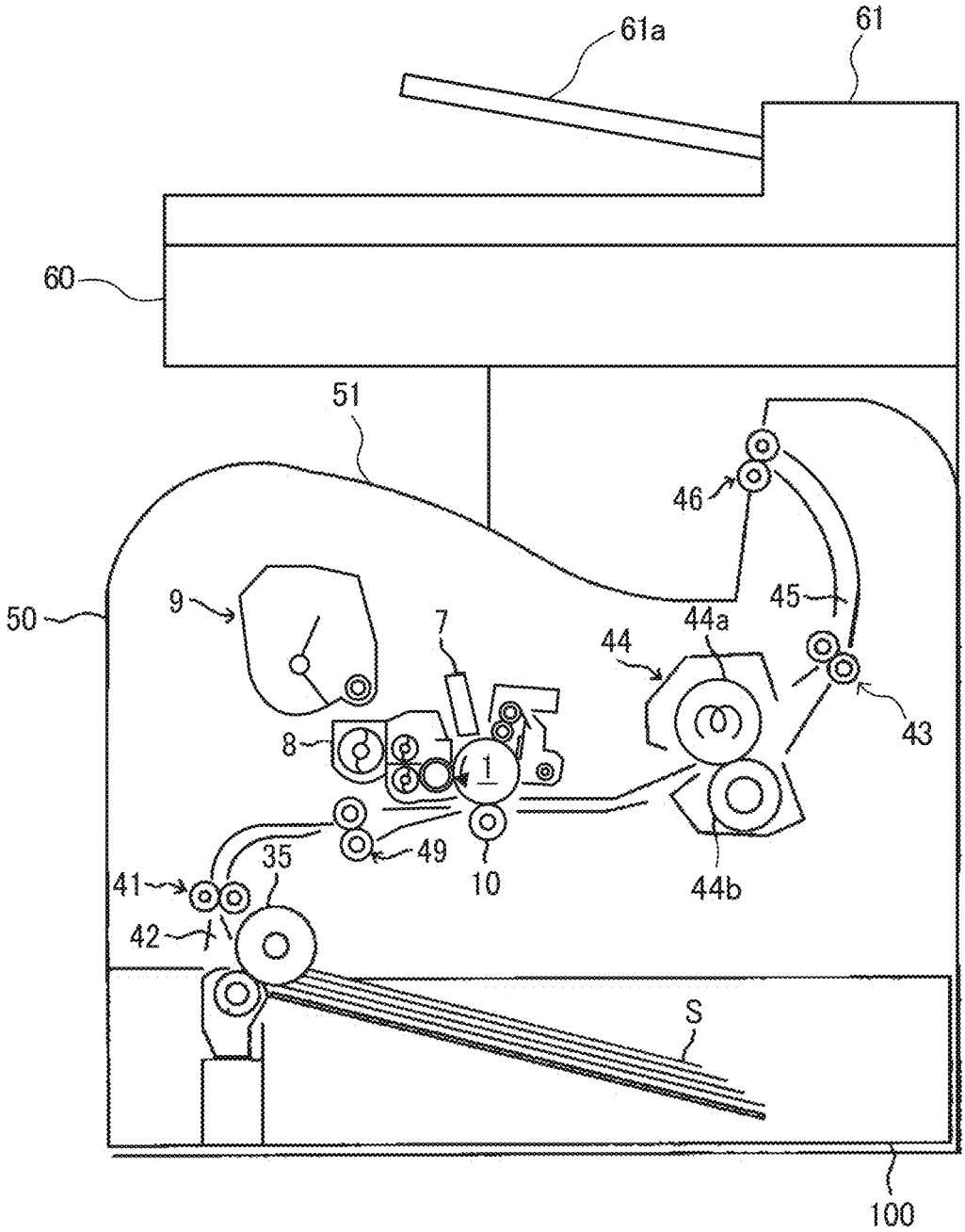
FIG. 1 is a schematic view of an image forming apparatus according to the present embodiment.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings illustrating the following embodiments, the same reference codes are allocated to elements (members or components) having the same function or shape and redundant descriptions thereof are omitted below.

A description is provided of a construction of an image forming apparatus of the present disclosure. The image forming apparatus forms an image using electrophotography.

A basic structure of the image forming apparatus according to the present embodiment is firstly described. FIG. 1 is a schematic view illustrating an image forming apparatus according to the present embodiment. As illustrated in FIG. 1, the image forming apparatus includes a photoconductor 1 as a latent image bearer, an apparatus body 50, and a sheet tray 100 that is detachably attachable to the apparatus body 50. The sheet tray 100 contains multiple sheets S as a sheet bundle, which serve as multiple recording media.

The sheet S in the sheet tray 100 is fed from the sheet tray 100 as a sheet feed roller 35 rotates, passes through a sheet separation nip region, and reaches a sheet conveyance path 42. The sheet feed roller 35 and the sheet separation nip region are described later. Thereafter, the sheet S is held by a pair of feed relay rollers 41 in a sheet conveyance nip region formed between the pair of feed relay rollers 41 and conveyed from an upstream side toward a downstream side in a sheet conveyance direction through the sheet conveyance path 42. A pair of registration rollers 49 is provided adjacent to a downstream end of the sheet conveyance path 42 in the sheet conveyance direction. Conveyance of the sheet S is temporarily stopped with the leading edge of the sheet S abutting against a registration nip area of the registration rollers 49. During the abutment of the sheet S, skew of the sheet S is corrected.

The registration rollers 49 start driving to feed the sheet S toward the transfer nip region to synchronize rotation of the registration rollers 49 with movement of the sheet S, so that the toner image formed on a surface of the photoconductor 1 is transferred onto the sheet S in a transfer nip region. At this timing, the feed relay rollers 41 starts rotating at the same time as the start of rotation of the registration rollers 49, so that conveyance of the sheet that has been halted is resumed.

Above the apparatus body 50, a scanner 60 is provided. An automatic document feeder 61 is mounted on the scanner 60. The automatic document feeder 61 includes a document sheet tray 61*a* to hold a bundle of original documents placed on the document sheet tray 61*a* to automatically feed the separated original document onto an exposure glass mounted on the scanner 60. The scanner 60 reads image data of the original document fed from the automatic document feeder 61 on the exposure glass.

Figure 2:
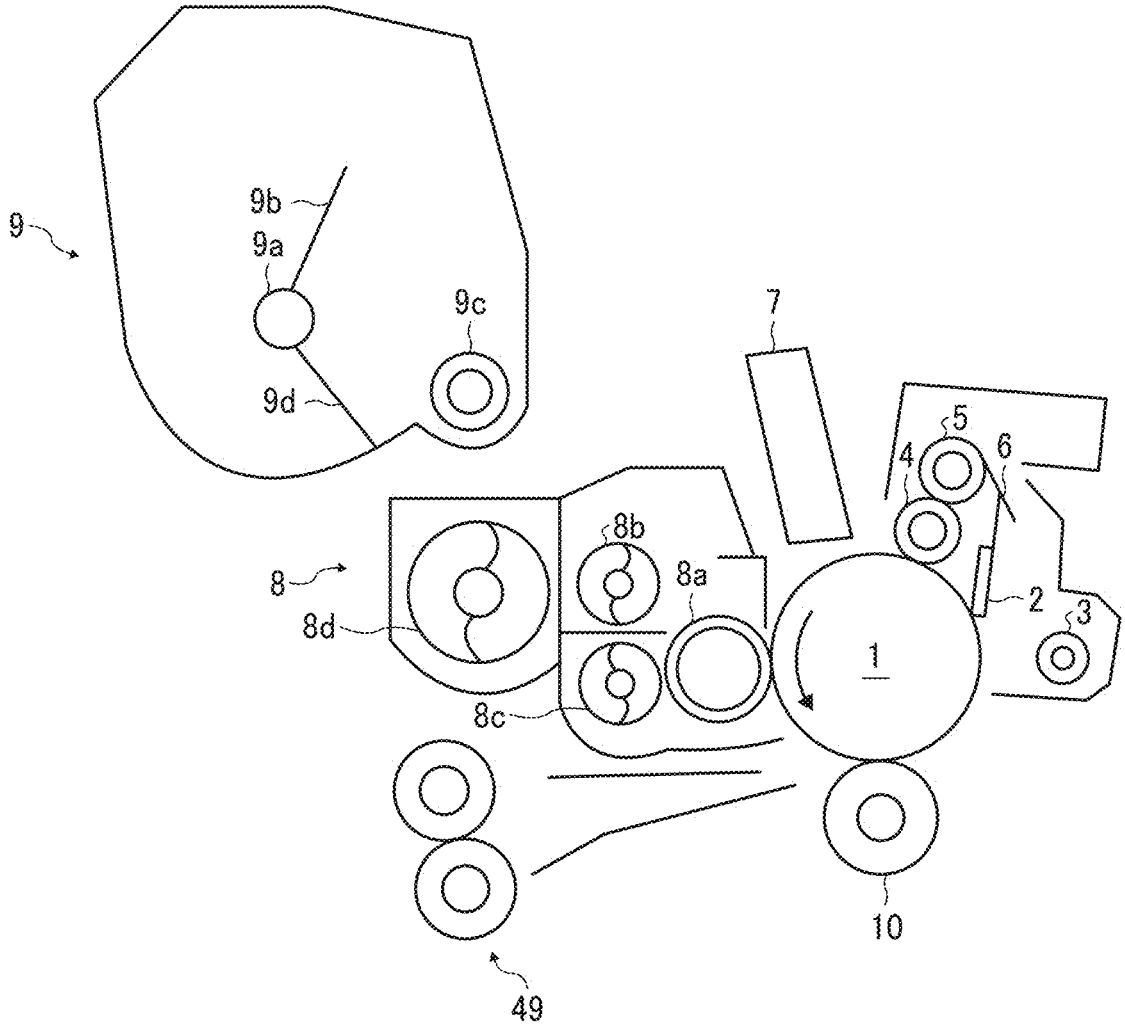
FIG. 2 is an enlarged view illustrating an image forming section of the image forming apparatus including a photoconductor and image forming devices disposed around the photoconductor included in the image forming apparatus of FIG. 1.

FIG. 2 is an enlarged view illustrating an image forming section including a photoconductor 1 and image forming devices disposed around the photoconductor 1 in the image forming apparatus of FIG. 1. The photoconductor 1 is a drum-shaped photoconductor that rotates counterclockwise in FIG. 2. The image forming devices disposed around the photoconductor 1 are a toner collection screw 3, a cleaning blade 2, a charging roller 4, a latent image writing device 7 as a latent image forming device, a developing device 8, a transfer roller 10 as a transfer device, and the like. The charging roller 4 includes a conductive rubber roller and forms a charging nip region by rotating while contacting the photoconductor 1. The charging roller 4 is applied with a charging bias that is output from a power source. Thus, in the charging nip region, an electrical discharge is induced between the surface of the photoconductor 1 and a surface of the charging roller 4. As a result, the surface of the photoconductor 1 is uniformly charged.

The latent image writing device 7 includes a light-emitting diode (LED) array and performs light scanning with LED light over the surface of the photoconductor 1 that has been uniformly charged based on image data input from a personal computer or image data of a document read by the scanner 60. On the surface of the photoconductor 1 that has been uniformly charged, an area having been subjected to the light irradiation through this light scanning attenuates the electric potential therein. This results in formation of an electrostatic latent image on the surface of the photoconductor 1.

As the photoconductor 1 rotates, the electrostatic latent image passes through a development region formed between the surface of the photoconductor 1 and the developing device 8 when the photoconductor 1 is brought to face the developing device 8. The developing device 8 has a circulation conveyance section and a developing section, and the circulation conveyance section accommodates a developer containing toner and magnetic carrier. The circulation conveyance section includes a first screw 8*b* for conveying the developer to be supplied to a developing roller 8*a*, a second screw 8*c* for conveying the developer in an independent space positioned beneath the first screw 8*b*. Further, the circulation conveyance section includes an inclined screw 8*d* for receiving the developer from the second screw 8*c* and supplying the developer to the first screw 8*b*. The developing roller 8*a*, the first screw 8*b*, and the second screw 8*c* are placed at attitudes parallel with each other. By contrast, the inclined screw 8*d* is placed at an attitude inclined with respect to the developing roller 8*a*, the first screw 8*b*, and the second screw 8*c*.

The first screw 8*b* conveys the developer from a distal side toward a proximal side in a direction perpendicular to the drawing sheet of FIG. 2 as the first screw 8*b* rotates. At this time, the first screw 8*b* supplies a part of the developer to the developing roller 8*a* that is disposed opposite to the first screw 8*b*. The developer having been conveyed by the first screw 8*b* to the vicinity of a proximal end portion of the first screw 8*b* in the direction perpendicular to the drawing sheet of FIG. 2 is dropped onto the second screw 8*c*.

The second screw 8*c* receives used developer from the developing roller 8*a* and, at the same time, conveys the received developer from the distal side toward the proximal side in the direction perpendicular to the drawing sheet of FIG. 2 as the second screw 8*c* rotates. The developer conveyed by the second screw 8*c* to the vicinity of the end portion thereof that is close in the direction perpendicular to the drawing sheet of FIG. 2 is supplied to the inclined screw 8*d*. Further, along with rotation of the inclined screw 8*d*, the developer is conveyed from the proximal side toward the distal side in the direction perpendicular to the drawing sheet of FIG. 2. Thereafter, the developer is supplied to the first screw 8*b* in the vicinity of the distal end portion thereof in the direction perpendicular to the drawing sheet of FIG. 2.

The developing roller 8*a* includes a developing sleeve and a magnet roller. The rotatable developing sleeve is a tubular-shaped rotatable non-magnetic member. The magnet roller is fixed to the developing sleeve in such a way as not to rotate together with the developing sleeve. The developing roller 8*a* takes up a part of the developer that is conveyed by the first screw 8*b* onto the surface of the developing sleeve due to a magnetic force generated by the magnet roller. The developer that is carried on the surface of the developing sleeve passes through an opposite position facing a doctor blade. At this time, the thickness of a layer of the developer on the surface of the developing sleeve is regulated while the developer is rotated together with the surface of the development sleeve. Thereafter, the developer on the developing roller 8*a* rubs the surface of the photoconductor 1 in the development region in which the developing roller 8*a* faces the photoconductor 1.

A development bias having the same polarity as the toner and as an electric potential in a background surface of the photoconductor 1 is applied to the developing sleeve. The absolute value of this development bias is greater than the absolute value of the electric potential of the latent image and is smaller than the absolute value of the electric potential in the background surface of the photoconductor 1. Therefore, in the development region, a developing potential acts between the developing sleeve of the developing device 8 and the electrostatic latent image formed on the photoconductor 1 in such a way as to electrostatically move the toner from the developing sleeve to the electrostatic latent image. By contrast, a background potential between the development sleeve of the developing device 8 and the background surface of the photoconductor 1 electrostatically moves the toner from the background surface to the developing sleeve. This causes the toner to selectively adhere to the electrostatic latent image formed on the surface of the photoconductor 1, so that the electrostatic latent image is developed in the development region.

The developer that has passed through the development region enters an opposite area in which the developing sleeve faces the second screw 8*c* as the developing sleeve rotates. In the opposite area, a repulsive magnetic field is formed by two magnetic poles having polarities different from each other out of multiple magnetic poles included in the magnet roller. The developer that has entered the opposite area is separated from the surface of the developing sleeve and is collected by the second screw 8*c* due to the effect of the repulsive magnetic field.

The developer that is conveyed by the inclined screw 8*d* contains the developer that has been collected from the developing roller 8*a*, and this developer is contributed to development in the development area, so that the toner concentration is lowered. The developing device 8 includes a toner concentration sensor for detecting the toner concentration of the developer to be conveyed by the inclined screw 8*d*. Based on detection results obtained by the toner concentration sensor, a main controller outputs a replenishment operation signal for replenishing the toner to the developer that is conveyed by the inclined screw 8*d*, as required.

A toner cartridge 9 is disposed above the developing device 8. In the toner cartridge 9, agitators 9*b* and 9*d* fixed to the rotary shaft 9*a* stir the toner accommodated in the toner cartridge. A toner supply member 9*c* is driven to rotate according to a supply operation signal output from the main controller 52 (see FIG. 5). With this operation, the toner in an amount corresponding to a rotation amount of the toner supply member 9*c* is supplied to the inclined screw 8*d* of the developing device 8.

The toner image formed on the surface of the photoconductor 1 as a result of the development by the developing device 8 enters the transfer nip region where the photoconductor 1 and the transfer roller 10 that functions as a transfer device contact each other as the photoconductor 1 rotates. A charging bias having the opposite polarity to the latent image electric potential of the photoconductor 1 is applied to the transfer roller 10. Accordingly, an electric field is formed in the transfer nip region.

As described above, the registration rollers 49 convey the sheet S toward the transfer nip region in synchronization with a timing at which the toner image formed on the photoconductor 1 is overlaid onto the sheet S in the transfer nip region. The toner image formed on the photoconductor 1 is transferred onto the sheet S that is closely contacted to the toner image in the transfer nip region due to the actions of the electric field in the transfer nip region and the nip pressure.

Residual toner that is not transferred onto the sheet S remains on the surface of the photoconductor 1 after having passed through the transfer nip region. The residual toner is scraped off from the surface of the photoconductor 1 by the cleaning blade 2 that is in contact with the photoconductor 1 and, thereafter, is conveyed toward an outside of a unit casing by the collection screw 3. The residual toner that is removed from the unit casing is transported to a waste toner bottle by a waste-toner conveyance device.

The surface of the photoconductor 1 that is cleaned by the cleaning blade 2 is electrically discharged by an electric discharging device. Thereafter, the surface of the photoconductor 1 is uniformly charged again by the charging roller 4. Foreign materials such as toner additive agents and the toner that has not been removed by the cleaning blade 2 adhere to the charging roller 4 that is in contact with the surface of the photoconductor 1. These foreign materials are shifted to a cleaning roller 5 that is in contact with the charging roller 4. Thereafter, the foreign materials are scraped off from the surface of the cleaning roller 5 by a scraper 6 that is in contact with the cleaning roller 5. The foreign materials scraped off from the surface of the cleaning roller 5 falls onto the toner collection screw 3.

In FIG. 1, the sheet S that has passed through the transfer nip region formed by the photoconductor 1 and the transfer roller 10 contacting each other is conveyed to a fixing device 44. The fixing device 44 includes a fixing roller 44*a* and a pressing roller 44*b*. The fixing roller 44*a* includes a heat source such as a halogen lamp. The pressing roller 44*b* presses against the fixing roller 44*a*. The fixing roller 44*a* and the pressing roller 44*b* contact each other to form a fixing nip region. The toner image is fixed to the surface of the sheet S that is held in the fixing nip region due to application of heat and pressure. Thereafter, the sheet S that has passed through the fixing device 44 passes through a sheet ejection path 45. Then, the sheet S is held in a sheet ejection nip region of sheet ejection rollers 46, and ejected to the outside of the apparatus by sheet ejection rollers 46. The ejected sheet S is stacked on a stack portion 51 provided on the upper surface of the apparatus body 50.

Figure 3:
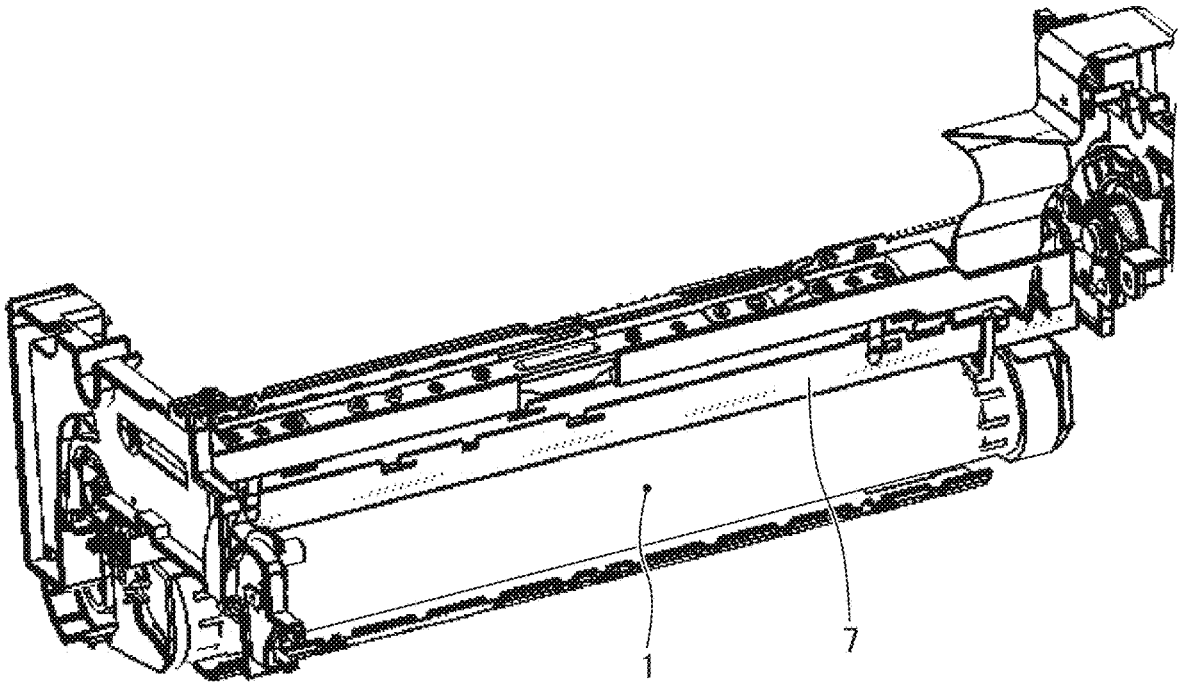
FIG. 3 is a perspective view illustrating a latent image writing device and a photoconductor.

FIG. 3 is a perspective view illustrating the latent image writing device 7 and the photoconductor 1.

Since a focal length of the LED array in the latent image writing device 7 is short, the latent image writing device 7 is disposed close to the photoconductor 1. In the present embodiment, the photoconductor 1, the charging roller 4, the developing device 8, and the cleaning blade 2 are included in a single unit as a process cartridge. The process cartridge is removably installable in the apparatus body 50 of the image forming apparatus. As illustrated in FIG. 3, the latent image writing device 7 disposed close to the photoconductor 1 hinders removal and installation of the process cartridge with respect to the apparatus body 50. To address this inconvenience, in the present embodiment, the retraction mechanism 200 is provided to the image forming apparatus so that the latent image writing device 7 can move between the latent image forming position at which the latent image writing device 7 is located close to the photoconductor 1 and a retracted position at which the latent image writing device 7 is located spaced away from the photoconductor 1.

Figure 4:
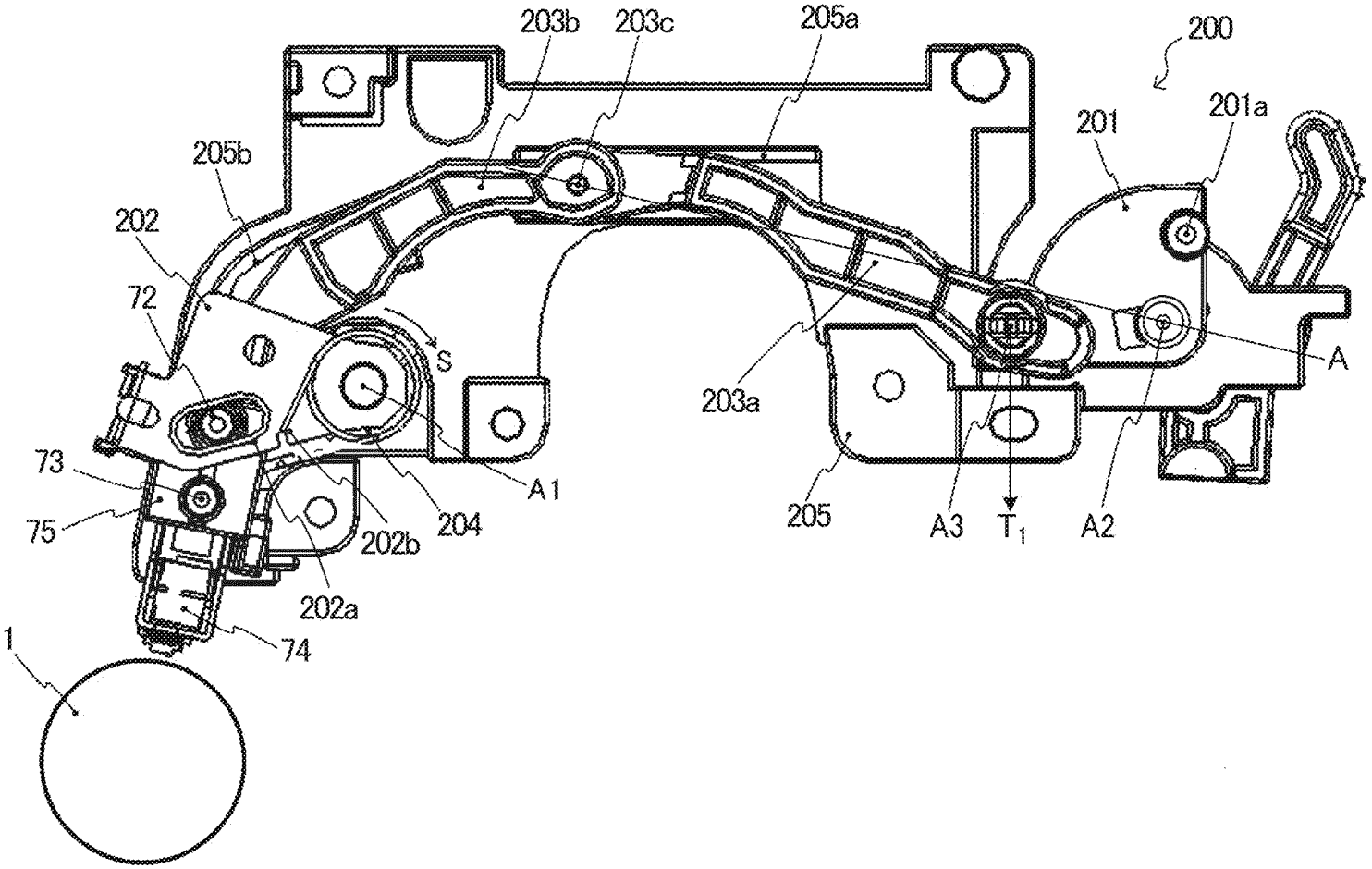
FIG. 4 is a diagram illustrating a schematic configuration of a retraction mechanism.

FIG. 4 is a diagram illustrating a schematic configuration of the retraction mechanism 200. Specifically, in FIG. 4, the latent image writing device 7 is located at the latent image forming position where an electrostatic latent image is formed on the surface of the photoconductor 1.

As illustrated in FIG. 4, the retraction mechanism 200 that functions as a moving unit includes a first link unit 201, a second link unit 202, and a connecting unit 203. The first link unit 201 is rotatably supported by the apparatus body of the image forming apparatus. The second link unit 202 that functions as a holder to hold the latent image writing device 7. The second link unit 202 is rotatably supported by the apparatus body 50 of the image forming apparatus. The connecting unit 203 functions as a connector to connect the first link unit 201 and the second link unit 202.

The connecting unit 203 includes a first connecting member 203*a* and a second connecting member 203*b*. One end of the first connecting member 203*a* is rotatably supported by the first link unit 201 and an opposed end of the first connecting member 203*a* is rotatably supported by a connecting shaft 203*c*. One end of the second connecting member 203*b* is rotatably supported by the connecting shaft 203*c* and an opposed end of the second connecting member 203*b* is rotatably supported by the second link unit 202. The connecting shaft 203*c* passes through a connection guide hole 205*a* formed in a cover unit 205. The connection guide hole 205*a* extends in left and right-side directions in FIG. 4.

The second link unit 202 has a support slot 202*a* that is an elongated hole extending toward a rotational support A1 of the second link unit 202. A support projection 72, which is provided on both ends in a longitudinal direction of the holder 75 that hold the LED array 74 of the latent image writing device 7, passes through the support slot 202*a*. By causing the support projection 72 of the holder 75 of the latent image writing device 7 to pass through the support slot 202*a*, the latent image writing device 7 is supported by the retraction mechanism 200. The support projection 72 also passes through the exposure device guide slot 205*b* that functions as a guide provided to the cover unit 205. The holder 75 of the latent image writing device 7 includes the guide projection 73 that passes through the exposure device guide slot 205*b*.

The first link unit 201 is a fan-shaped unit having a central angle of approximately 90 degrees. The first connecting member 203*a* is rotatably supported at one end in a circumferential direction of the first link unit 201. A boss section 201*a* is disposed at an opposed end in the circumferential direction of the first link unit 201.

A hook 202*b* is disposed at the second link unit 202. The hook 202*b* functions as a biasing member to hook one end of a torsion spring 204. One end of the torsion spring 204 is hooked to the hook 202*b* and an opposed end of the torsion spring 204 is hooked to the cover unit 205. By so doing, the torsion spring 204 biases the second link unit 202 to a direction indicated by arrow S illustrated in FIG. 4.

Due to a biasing force generated by the torsion spring 204, the second link unit 202 and the connecting shaft 203*c* (i.e., the first connecting member 203*a* and the second connecting member 203*b*) receive respective forces to move to the first link unit 201. At this time, a support position A3 of the first connecting member 203*a* is located below a line segment A connecting a rotational support A2 of the first link unit 201 and the connecting shaft 203*c* in FIG. 4. Consequently, a force applied to move the connecting shaft 203*c* to the first link unit 201 generates a force to move to the support position A3 in a direction indicated by arrow T1 in FIG. 4. As a result, a force to move the first link unit 201 in a counterclockwise direction is generated. Accordingly, the latent image writing device 7 is biased toward the photoconductor 1, so that the latent image writing device 7 is located at the latent image forming position.

As the cover of the apparatus body 50 opens to attach and detach the process cartridge, the hooking lever disposed the cover contacts the boss section 201*a* of the first link unit 201, and the first link unit 201 turns in the clockwise direction in FIG. 4 against the biasing force of torsion spring 204. When the first link unit 201 turns against the biasing force of torsion spring 204, and the support position A3 of the first connecting member 203*a* of the first link unit 201 moves above the line segment A connecting a rotational support A2 of the first link unit 201 and the connecting shaft 203*c*, the direction in which the biasing force of the torsion spring 204 rotates the first link member 101 is switched from the counterclockwise direction in FIG. 4 to the clockwise direction in FIG. 4. As a result, the first link unit 201 automatically turns in the direction to move the latent image writing device 7 toward the retracted position by the biasing force applied by the torsion spring 204 (the counterclockwise direction in FIG. 4), and therefore the latent image writing device 7 moves to the retracted position.

In the LED array 74, light quantity of each LED 74*b* is not the same light quantity even if the same voltage is applied to each LED 74*b* because of variation of shape and property of each LED 74*b*, small displacement in an arrangement of LED chips, and cyclic or non-cyclic change in optical properties of the LED array. Light quantity difference causes image density unevenness in the width direction of the sheet S (hereinafter referred to as main scanning direction) in the image formed on the sheet S. The image density unevenness in the main scanning direction results in vertical streaks, vertical bands or the like extending in the conveyance direction of the sheet S (hereinafter referred to as the sub-scanning direction) and the image quality is deteriorated.

Therefore, light quantity of each LED 74*b* is measured beforehand using a predetermined device, and a first light quantity correction value to correct electric power applied to each LED 74*b* is determined so that each LED 74*b* emits light with the same light quantity. The first light quantity correction value is stored in a memory of the image forming apparatus. Controlling the LED array 74 based on the first light quantity correction value enables to decrease the image density unevenness in the main scanning direction due to the LED array 74.

However, the image density unevenness in the main scanning direction is caused not only by the LED array 74, but also by an image forming engine such as the photoconductor 1, the charging roller 4, the developing device 8, the transfer roller 10, and the fixing device 44. In the present In the present embodiment, to decrease the image density unevenness in the main scanning direction caused by the image forming engine, the LED array 74 is controlled based on the first light quantity correction value, a test pattern is formed on the sheet S, and the test pattern formed on the sheet S is read by the scanner 60. The image density unevenness in the main scanning direction caused by the image forming engine is obtained based on data read by the scanner 60. Based on the obtained image density unevenness in the main scanning direction, a second light quantity correction value is calculated to correct the light quantity of each LED, that is, an electric power applied to each LED. The third light quantity correction value is calculated based on the first light quantity correction value to decrease the image density unevenness in the main scanning direction caused by the LED array 74 and the second light quantity correction value to decrease the image density unevenness in the main scanning direction caused by the image forming engine. Writing the latent image on the photoconductor 1 by the LED array 74 controlled based on the third light quantity correction value during image formation makes it possible to decrease both the image density unevenness caused by the LED array 74 and the image forming engine and form a high-quality image.

Figure 5:
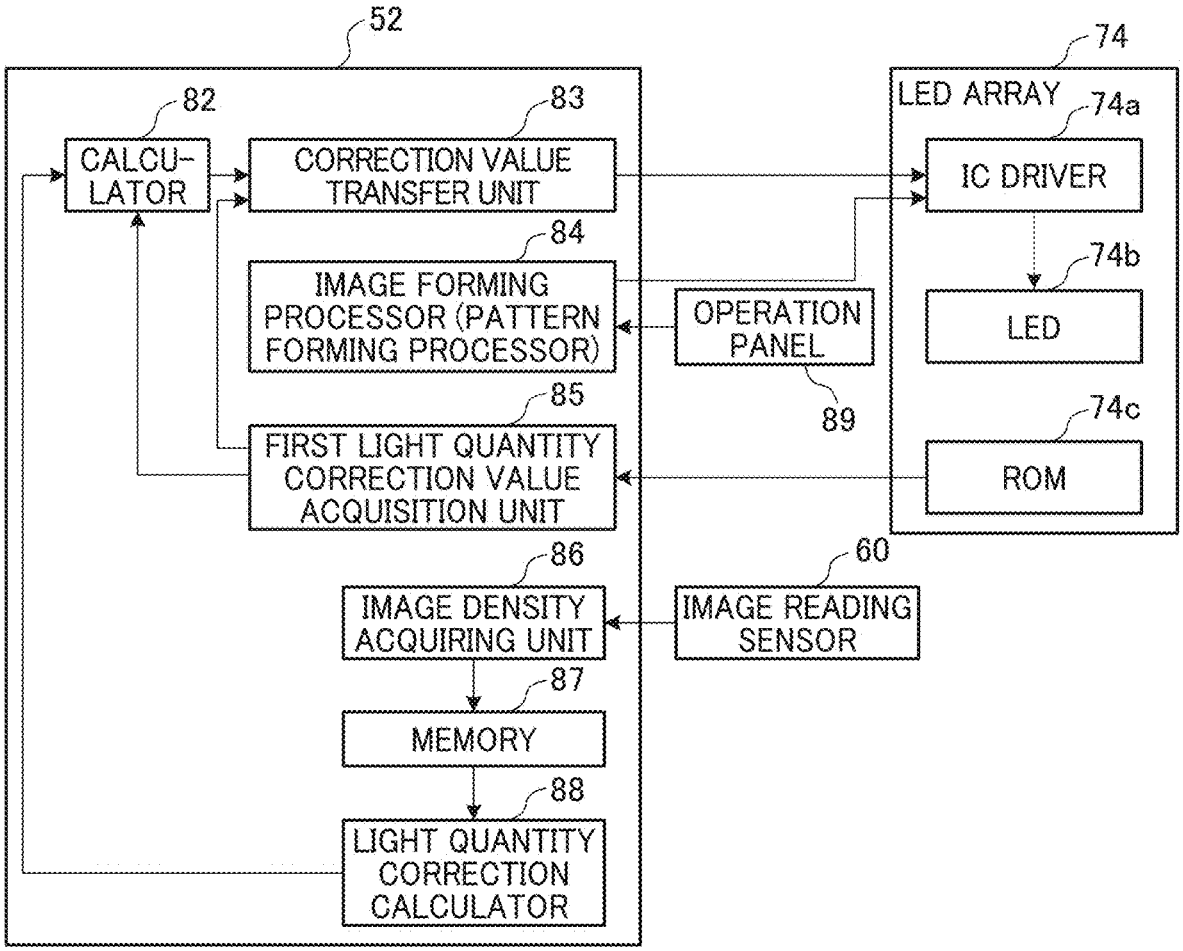
FIG. 5 is a block diagram illustrating a part of an electrical circuit for image density unevenness correction in a main scanning direction.

FIG. 5 is a block diagram illustrating a part of an electrical circuit for image density unevenness correction in a main scanning direction.

As illustrated in FIG. 5, the LED array 74 included in the latent image writing device 7 includes a plurality of LEDs 74*b* arranged in the main scanning direction, integrated circuit (IC) drivers 74*a* to drive each of the LEDs, and a read only memory (ROM) 74*c* to store first light quantity correction values to correct unevenness of light quantity of the LED array.

The main controller 52 that controls overall control of the image forming apparatus includes an image density acquiring unit 86 that acquires image density in the main scanning direction based on read data obtained by the scanner 60 that reads the test pattern formed on the sheet S, a memory 87 to store image density data obtained by the image density acquiring unit 86, and a light quantity correction calculator 88 to calculate the second light quantity correction value to correct a light quantity of each LED.

The main controller 52 includes a first light quantity correction value acquisition unit 85 to obtain the first light quantity correction value, a calculator 82 to calculate a third light quantity correction value used in the image formation based on the first light correction value obtained by the first light quantity correction value acquisition unit 85 and the second light quantity correction value calculated by the light quantity correction calculator 88. In addition, the main controller 52 includes a correction value transfer unit 83 that transfers the third light quantity correction value calculated by the calculator 82 to the LED array 74 during image formation. The main controller 52 also includes an image forming processor 84 that controls an image forming engine including the photoconductor 1, the charging roller 4, the developing device 8, the transfer roller 10, the fixing device 44, etc. and forms an image on the sheet S. The image forming processor 84 controls test pattern formation to the sheet S. As described later, the image forming processor 84 sets a position of the test pattern and a test pattern length in the sub-scanning direction based on data of the sheet length in the sub-scanning direction obtained by the control panel 89 as a length data acquisition unit and a sheet conveyance distance between conveyance members to convey the sheet S.

Figure 6:
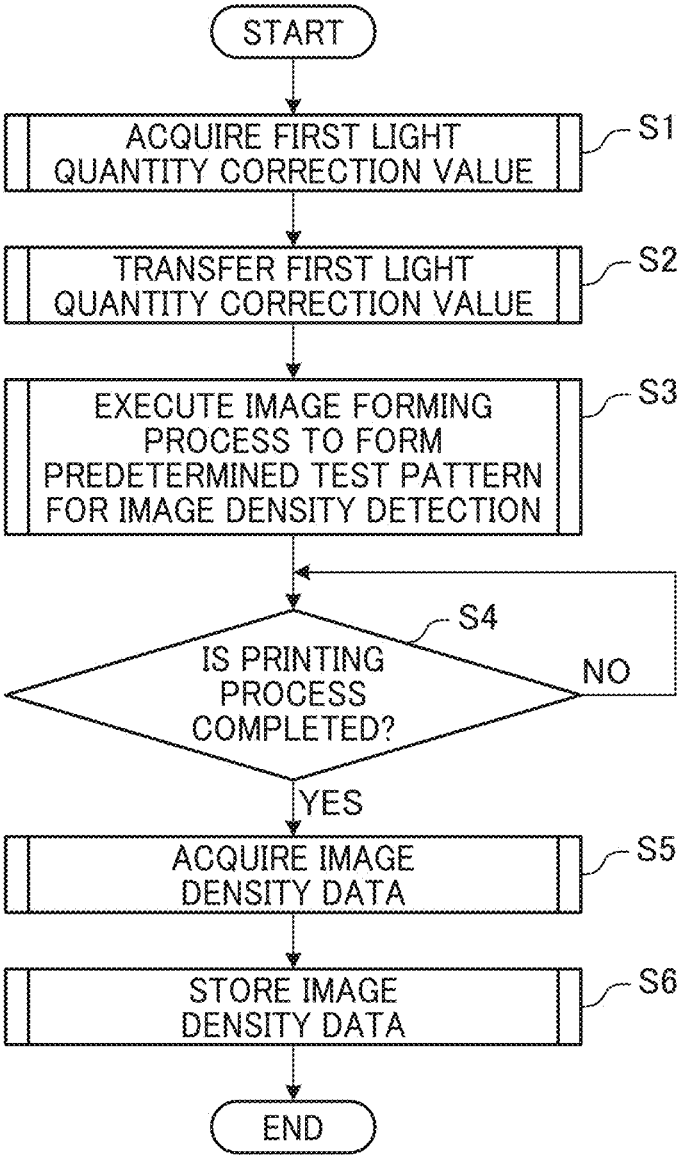
FIG. 6 is a flowchart of an image density unevenness acquisition in the main scanning direction.

FIG. 6 is a flowchart of an image density unevenness acquisition in the main scanning direction.

In step S1, the first light quantity correction value acquisition unit 85 of the main controller 52 acquires the first light quantity correction value stored in the ROM 74*c* of the LED array 74. The first light quantity control value is data to correct the electric power applied to each of the LEDs 74*b* so that the light quantity of each of the LEDs becomes the same quantity. The first light quantity control value is determined based on light quantity of each of the LEDs of the LED array 74 that is measured by a specific measurement device.

In step S2, the main controller 52 transfers the acquired first light quantity correction value from the correction value transfer unit 83 to the IC driver 74*a* in the LED array 74. In step S3, the image forming processor 84 transmits control signals to each device of the image forming engine and executes image forming process to form the test pattern. After the IC driver 74*a* in the LED array 74 receives the control signal and test pattern data from the image forming processor 84, the IC driver 74*a* controls each of LEDs 74*b* based on the first light quantity control value transmitted from the correction value transfer unit 83 to form a latent image of the test pattern on the photoconductor 1. The IC driver 74*a* also controls start emission timing and end emission timing of LED array 74 based on the position of the test pattern and the test pattern length in the sub-scanning direction set by the image forming processor 84.

Figure 7A:
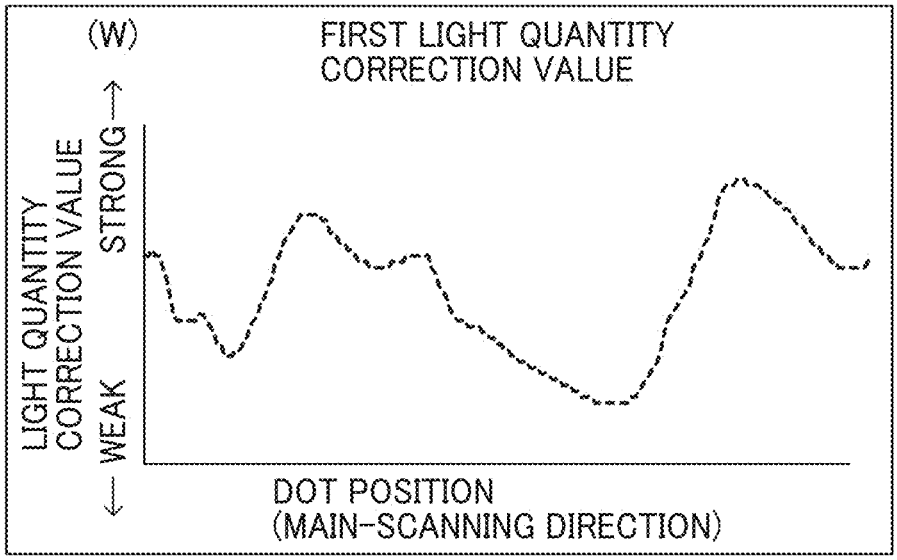
FIG. 7A is a graph illustrating an example of a first light quantity correction value.
Figure 7B:
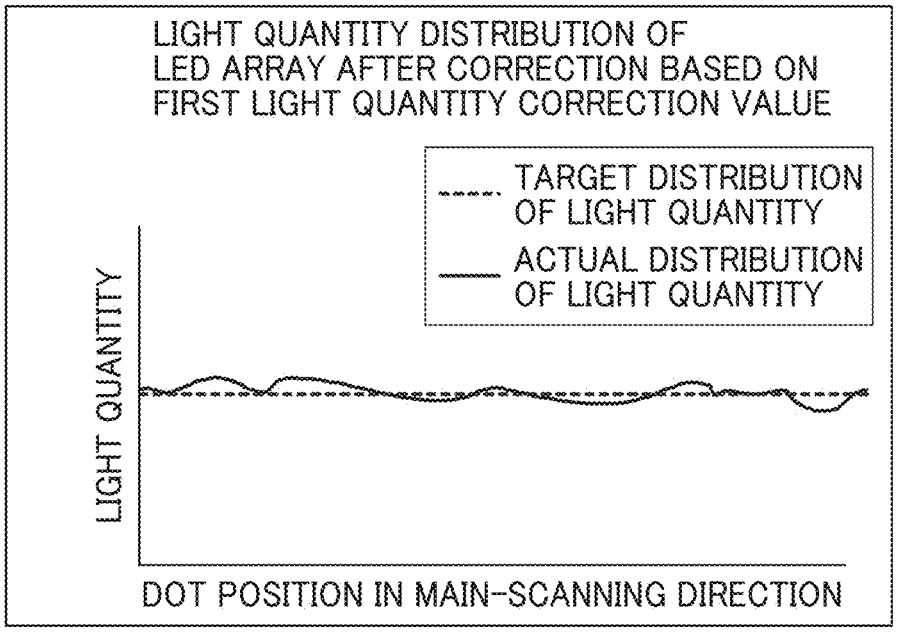
FIG. 7B is a graph illustrating a light quantity distribution in the main scanning direction when each of a plurality of LED elements is controlled based on the first light quantity correction value.

FIG. 7A is a graph illustrating an example of a first light quantity correction value. FIG. 7B is a graph illustrating light quantity distribution in the main scanning direction when each LED element is controlled based on the first light quantity correction value.

A position where the first light quantity correction value in the main-scanning direction is large as illustrated in FIG. 7A is a position where emission light quantity is small. Therefore, the IC driver 74*a* sets the first light quantity correction value (that is, electric power applied the LED) at the position larger to lead the light quantity at the position to a target light quantity. On the other hand, a position where the first light quantity correction value (that is, corrected electric power applied the LED) in the main-scanning direction is small is a position where emission light quantity is large. Therefore, the IC driver 74*a* sets the first light quantity correction value (that is, corrected electric power applied the LED) at the position smaller to lead the light quantity at the position to a target light quantity. Thereby, as illustrated in FIG. 7B, the emitted light quantity can be made substantially uniform in the main scanning direction.

After the IC driver 74*a* forms the latent image of the test pattern on the photoconductor 1, the developing device 8 develops the latent image of the test pattern, the transfer roller 10 transfers the developed image onto a predetermined position on the sheet S, and the fixing device 44 fixes the transferred image on the sheet S. After the sheet S on which the test pattern is formed is discharged and printing process is completed (Yes in step S4), a process of acquiring image density data of the test pattern starts (step S5). The memory 87 stores the acquired image density data (step S6).

Figure 8:
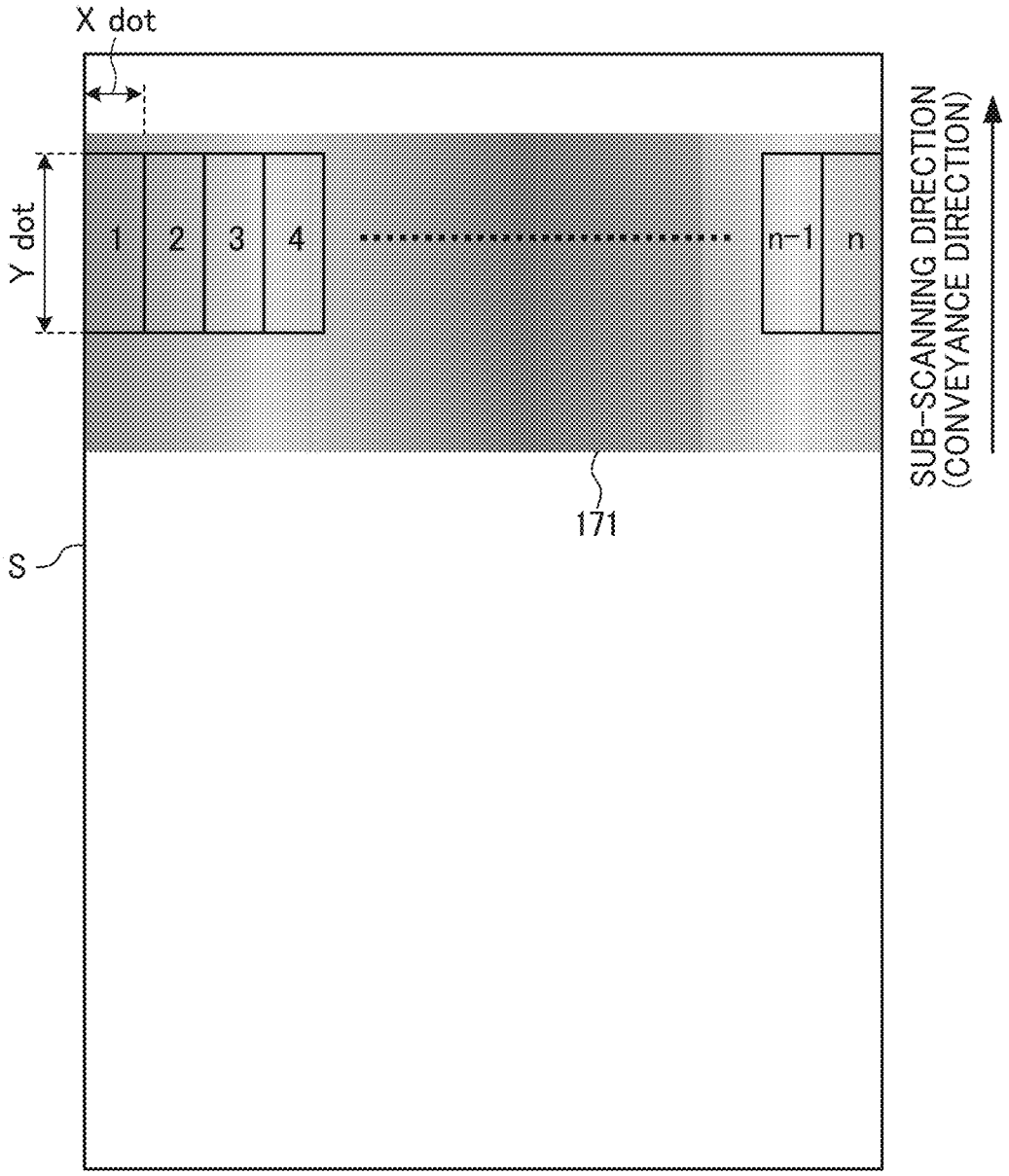
FIG. 8 is an explanatory diagram illustrating an example of a test pattern formed on a sheet.

FIG. 8 is an explanatory diagram illustrating an example of a test pattern 171 formed on the sheet S.

As illustrated in FIG. 8, the test pattern 171 is a uniform halftone image in both the main scanning direction and the sub-scanning direction. The sub-scanning direction is a conveyance direction in which the sheet S is conveyed. The main scanning direction is a width direction. Using a halftone image as the test pattern is preferable because the halftone image enables good detection for both a portion where the brightness is brighter than a target brightness (that is, the image density is smaller than a target image density) and the portion where the brightness is darker than the target brightness (that is, the image density is greater than the target image density). When the test pattern is formed, a sheet length in the main scanning direction is preferably equal to the maximum size in which the image forming apparatus can make an image in the main scanning direction. Preferably, the test pattern has the maximum size in the main scanning direction. Thereby, an output image at both ends in the main scanning direction can be corrected.

The test pattern 171 including image density unevenness in the main scanning direction causes longitudinal streaks, longitudinal bands, and the like extending in the sub-scanning direction to appear. The IC driver 74*a* controls each of LEDs 74*b* to form the latent image of the test pattern 171 described above based on the first light quantity correction value illustrated in FIG. 7A. As illustrated in FIG. 7B, the light quantity emitted from the each of LEDs 74*b* to the surface of the photoconductor is substantially uniform in the main scanning direction. Therefore, since a surface potential of the photoconductor almost evenly attenuates to a certain potential in the main scanning direction, if there is an image density unevenness of the test pattern in the main scanning direction, the image density unevenness is caused by a factor different from the LED array 74.

After the test pattern 171 is printed on the sheet S, the main controller 52 displays, on a control panel 89 of the image forming apparatus, an instruction to set the sheet S formed on the test pattern 171 on the scanner 60 and read the test pattern 171. When the operator sets the sheet S, on which the test pattern 171 is formed, on the scanner 60 and starts reading the test pattern 171 based on the instruction of the control panel 89, the image density acquiring unit 86 of the main controller 52 acquires image density data in the main scanning direction as image density information (step S5).

As illustrated in FIG. 8, an example of a method of acquiring the image density data in the image density acquiring unit 86 is a method in which the image density acquiring unit 86 divides the test pattern 171 into a plurality of areas 1 to n having a predetermined area (X dot×Y dot) to acquire an average image density in each of area 1 to area n.

For example, when "X dot" equals 1 dot, and image density data in the main scanning direction (width direction) of the A4 size sheet S is acquired at a resolution of 600 dpi, the image density data becomes data of 210 mm×(600 dpi/25.4 mm)≈4960 areas. If the image density data is represented by 8 bits (i.e., from 0 to 255), a storage capacity of 4960×8 bits=4.96 kilobytes is required. If the "X dot" equals 2 dots or 4 dots, the required storage capacity is halved or quartered, reducing the cost of the memory 87 in FIG. 5. By contrast, if the "X dot" is excessively increased, the image density of an increased area is averaged, lowering the accuracy of the image density information. The value of "X dot" and the resolution of the image density data may be appropriately determined according to the image forming apparatus. For example, the value of "X dot" may be determined based on whether the image density unevenness in the main scanning direction mainly has high frequency unevenness or low frequency unevenness.

On the other hand, a value of the "Y dot" in each of areas 1 to n does not affect the storage capacity. Therefore, the value of the "Y dot" is determined so as not to cause relatively large differences between results of detection of image density, taking into account an image density unevenness in the sub-scanning direction (i.e. the conveyance direction) in the target image forming system, including a non-periodic unevenness in image density or a periodic unevenness in image density due to, e.g., a cycle of the photoconductor 1, a cycle of the transfer roller 10, and a cycle of the developing roller 8*a*. However, an excessively increased value of the "Y dot" lengthens the time to acquire the image density data. Therefore, the value of the "Y dot" is determined in consideration of a balance between required accuracy and data acquisition time (i.e., processing capacity).

The main controller 52 executes the image density unevenness acquisition in the main scanning direction illustrated in FIG. 6 whenever requested, a timing at which members constituting the image forming engine such as the photoconductor 1 and the latent image writing device 7 are replaced, and a timing when the image forming apparatus is powered on. Executing the image density unevenness acquisition in the main scanning direction when the image forming apparatus is powered on brings about an advantage that it is always possible to output an image without image density unevenness in the main scanning direction. However, the image density unevenness acquisition according to the present embodiment needs the operation of the user that is setting the sheet S on which the test pattern 171 is formed in the scanner 60 to read the test pattern 171. Therefore, some users may be annoyed at the operation at every time when the image forming apparatus is powered on. Preferably, the user has an option that makes it possible for the user to stop the image density unevenness acquisition at every time when the image forming apparatus is powered on.

Figure 9:
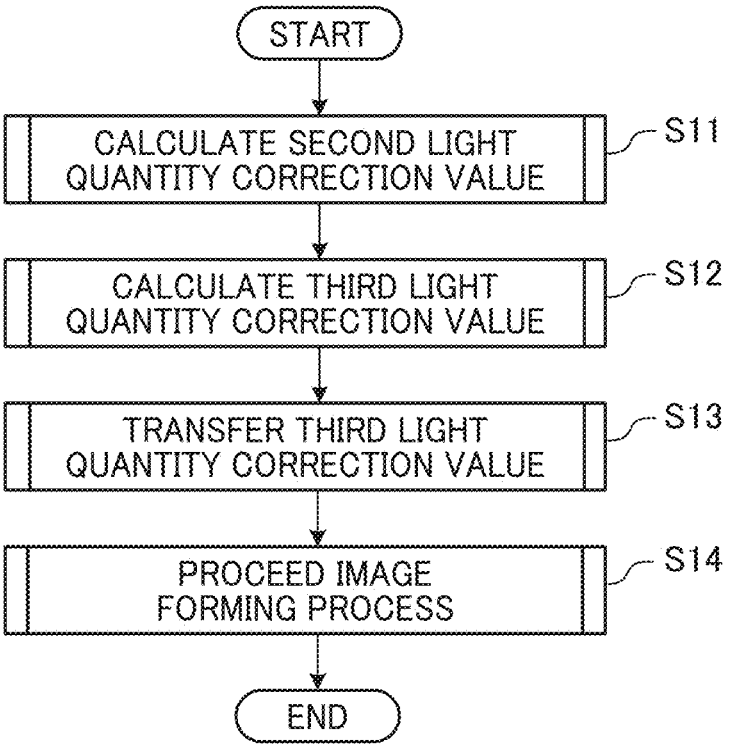
FIG. 9 is a flowchart of a control of an image forming process according to the present embodiment.

FIG. 9 is a flowchart of a control of the image forming process according to the present embodiment.

As illustrated in FIG. 9, when the main controller 52 receives an image formation start signal, the main controller 52 reads the image density data stored in the memory 87, and calculates the second light quantity correction value based on the image density data read by the light quantity correction calculator 88 (step S11).

Figure 10A:
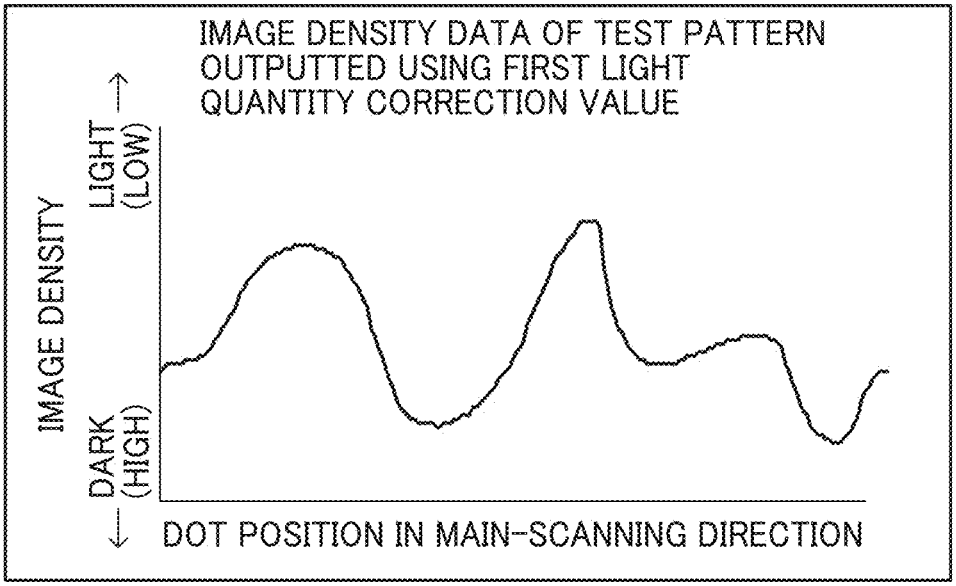
FIG. 10A is a graph illustrating an example of image density data stored in a memory.
Figure 10B:
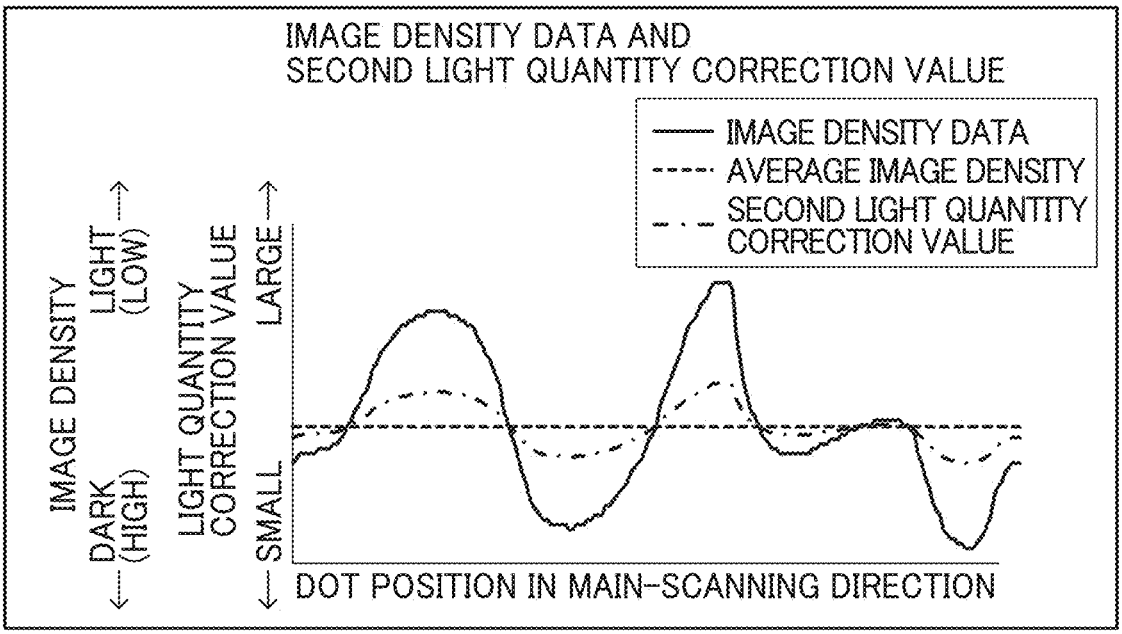
FIG. 10B is a graph illustrating the image density data (a solid line), an average image density value (a broken line), and a second light quantity correction value (a dashed-dotted line)

FIG. 10A is a graph illustrating an example of image density data stored in the memory 87, and FIG. 10B is a graph illustrating the image density data (a solid line), an average image density value (a broken line), and a second light quantity correction value (a dashed-dotted line). The average image density value illustrated in FIG. 10B indicates the average value of the image density indicated by the image density data.

Factors other than the LED array causes image density unevenness in the main scanning direction as illustrated in FIG. 10A. The image density unevenness in the main scanning direction in FIG. 10 is caused by the image forming engine other than LED array, that is, the photoconductor 1, the charging roller 4, the developing device 8, the transfer roller 10, and the fixing device 44.

As illustrated in FIG. 10B, the light quantity correction calculator 88 calculates the second light quantity correction value based on the average image density value that is the average value of the image density of the test pattern and the image density at each position in the main scanning direction indicated by the image density data. As illustrated in FIG. 10B, the main controller 52 increase light quantity of the LED 74*b* at a position where the image density data illustrated by a solid line in FIG. 10B is low, that is, light, and reduces the light quantity of the LED 74*b* at a position where the image density data is high, that is, dark. Specifically, the light quantity correction calculator 88 calculates the second light quantity correction value that increases the electric power applied to the LED 74*b* at the position where the image density is lower, that is, lighter than the average image density and calculates the second light quantity correction value that reduces the electric power applied to the LED 74*b* at the position where the image density is higher, that is, darker than the average image density.

After the light quantity correction calculator 88 calculates the second light quantity correction value, the calculator 82 calculates the third light quantity correction value used for image formation as illustrated step S12 in FIG. 9. Specifically, the calculator 82 calculates the third light quantity correction value based on the second light quantity correction value calculated by the light quantity correction calculator 88 and the first light quantity correction value which the first light quantity correction value acquisition unit 85 acquires from the LED array 74. The calculated third light quantity correction value is transferred to the IC driver 74*a* of the LED array 74 by the correction value transfer unit 83 (step S13). After the correction value transfer unit 83 transfers the calculated third light quantity correction value to the IC driver 74*a* of the LED array 74, the IC driver 74*a* executes the image forming process based on the image data. In the image forming process, the IC driver 74*a* forms a latent image on the surface of the photoconductor based on the third light quantity correction value transferred from the correction value transfer unit 83 and the image data.

Figure 11A:
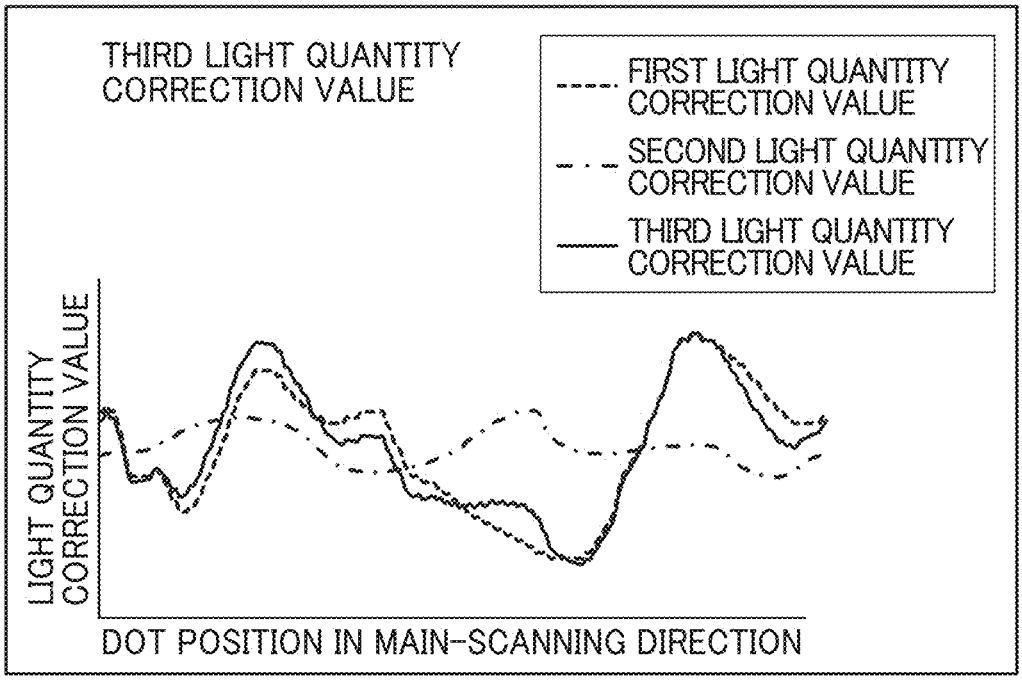
FIG. 11A is a graph illustrating a relation between (a) the first light quantity correction value (a broken line), the second light quantity correction value (a dashed-dotted line), and a third light quantity correction value (solid line)
Figure 11B:
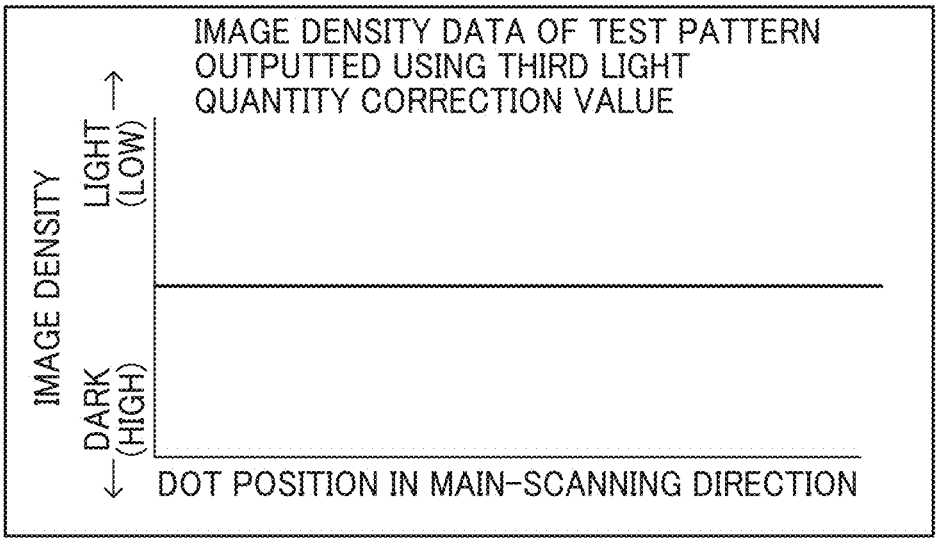
FIG. 11B is a graph illustrating an image density of a test pattern developed a latent image of the test pattern formed based on the third light quantity correction value.

FIG. 11A is a graph illustrating a relation between the first light quantity correction value (a broken line), the second light quantity correction value (a dashed-dotted line), and the third light quantity correction value (solid line), and FIG. 11B is a graph illustrating image density of the test pattern when the latent image of the test pattern is formed based on the third light quantity correction value.

As illustrated in FIG. 11A, the third light quantity correction value is calculated by adding the first light quantity correction value and the second light quantity correction value. The method of calculating the third light quantity correction value is not limited to this, and may be appropriately determined according to the calculation method of the first light quantity correction value and the second light quantity correction value.

The third light quantity correction value is a value calculated based on the first light quantity correction value that corrects the image density unevenness in the main scanning direction caused by the LED array 74 and the second light quantity correction value that corrects the image density unevenness in the main scanning direction caused by the image forming engine. Therefore, in the image formed based on the third light quantity correction value, the image density unevenness in the main scanning direction caused by the LED array 74 and the image forming engine is decreased. That is, the image whose latent image is formed by the light quantity corrected based on the third light quantity correction value has a uniform image density distribution in the main scanning direction as illustrated in FIG. 11B and high image quality without a vertical streak and a vertical band.

The flowchart of the present embodiment illustrated in FIG. 9 terminates the image density unevenness acquisition when the image density acquiring unit 86 of the main controller 52 acquires image density data of the test pattern 171 in the main scanning direction and the memory 87 stores the acquired image density data, but the flowchart proceeds the calculation of the second light quantity correction value. When the second light quantity correction value is calculated, the second light quantity correction value is stored in the memory 87. Further, in the acquisition control of the image density unevenness in the main scanning direction, the third light quantity correction value may be calculated. When the third light quantity correction value is calculated, the third light quantity correction value is stored in the memory 87. In this case, when the main controller 52 executes the image forming process, the first light quantity correction value acquisition unit 85 may not acquire the first light quantity correction value from the LED array 74, and the main controller 52 transmits the third light quantity correction value stored in the memory 87 to the IC driver 74*a* of the LED array 74.

The main controller 52 may determine whether the correction of the image density unevenness in the main scanning direction is necessary based on the image density data of the test pattern 171. When the main controller 52 determines that the correction of the image density unevenness in the main scanning direction is not necessary, the main controller 52 may control the LED array 74 based on the first light quantity correction value without calculating the third light correction value and execute the image forming process.

When the user or the customer engineer observes an outputted image with corrected image density unevenness in the main scanning direction and determines that the image density unevenness in the main scanning direction does not decrease, the main controller 52 may provide the user or the customer engineer an option in which the main controller 52 does not calculate the third light quantity correction value. When this option is selected, for example, the main controller 52 deletes the image density data stored in the memory 87 and controls the LED array 74 based on the first light quantity correction value.

The test pattern 171 may be formed without using the first light quantity correction value. The test pattern includes the image density unevenness in the main scanning direction having the image density unevenness in the main scanning direction due to the LED array 74 superimposed on the image density unevenness in the main scanning direction due to factors other than the LED array. The scanner 60 reads the image density unevenness in the main scanning direction, and the main controller 52 acquires the read data. The main controller 52 calculates the third light quantity correction value based on the image density unevenness in the main scanning direction in which the image density unevenness in the main scanning direction due to the LED array 74 and the image density unevenness in the main scanning direction caused by factors other than the LED array 74 are superimposed.

However, it is preferable that the test pattern 171 is formed after decreasing the image density unevenness in the main scanning direction due to the LED array 74 by the first light quantity correction value, and the image density unevenness in the main scanning direction due to factors other than the LED array 74 is acquired from the test pattern 171. The image density unevenness in the main scanning direction of the test pattern formed without using the first light quantity correction value becomes the image density unevenness in the main scanning direction due to the LED array 74 superimposed on the image density unevenness in the main scanning direction due to factors other than the LED array 74. As a result, for example, a high image density portion where the image density is increased due to the LED array 74 may be superimposed on a high image density portion where the image density is increased due to factors other than the LED array. The superimposed image density may reach and exceed an upper limit value of the image density. Specifically, an example is described in which the test pattern 171 is formed with an image density that is an intermediate tone having 127 gradations in 255 gradations. When the high image density portion where the image density unevenness due to the LED array 74 is dark by 70 gradations is superimposed on the high image density portion where the image density unevenness due to factors other than the LED array 74 is dark by 70 gradations, the image density unevenness at the superimposed portion is dark by 140 gradations. However, since there is an upper limit value of the image density that the scanner 60 can detect, which is gradation value 0 in this case, the image density unevenness at the superimposed portion which the scanner 60 can detect is dark by 127 gradations. Therefore, when the light quantity of each LED is corrected by the correction data calculated based on the image density data of the test pattern, the image density unevenness remains.

In the present embodiment, the test pattern 171 is formed after reducing the image density unevenness in the main scanning direction due to the LED array 74 with the first light quantity correction value. Since the test pattern 171 includes only image density unevenness in the main scanning direction caused by factors other than the LED array, the disadvantage described above may be avoided. Consequently, the present embodiment provides an advantage that the image density unevenness in the main scanning direction is decreased well.

Figure 12A:
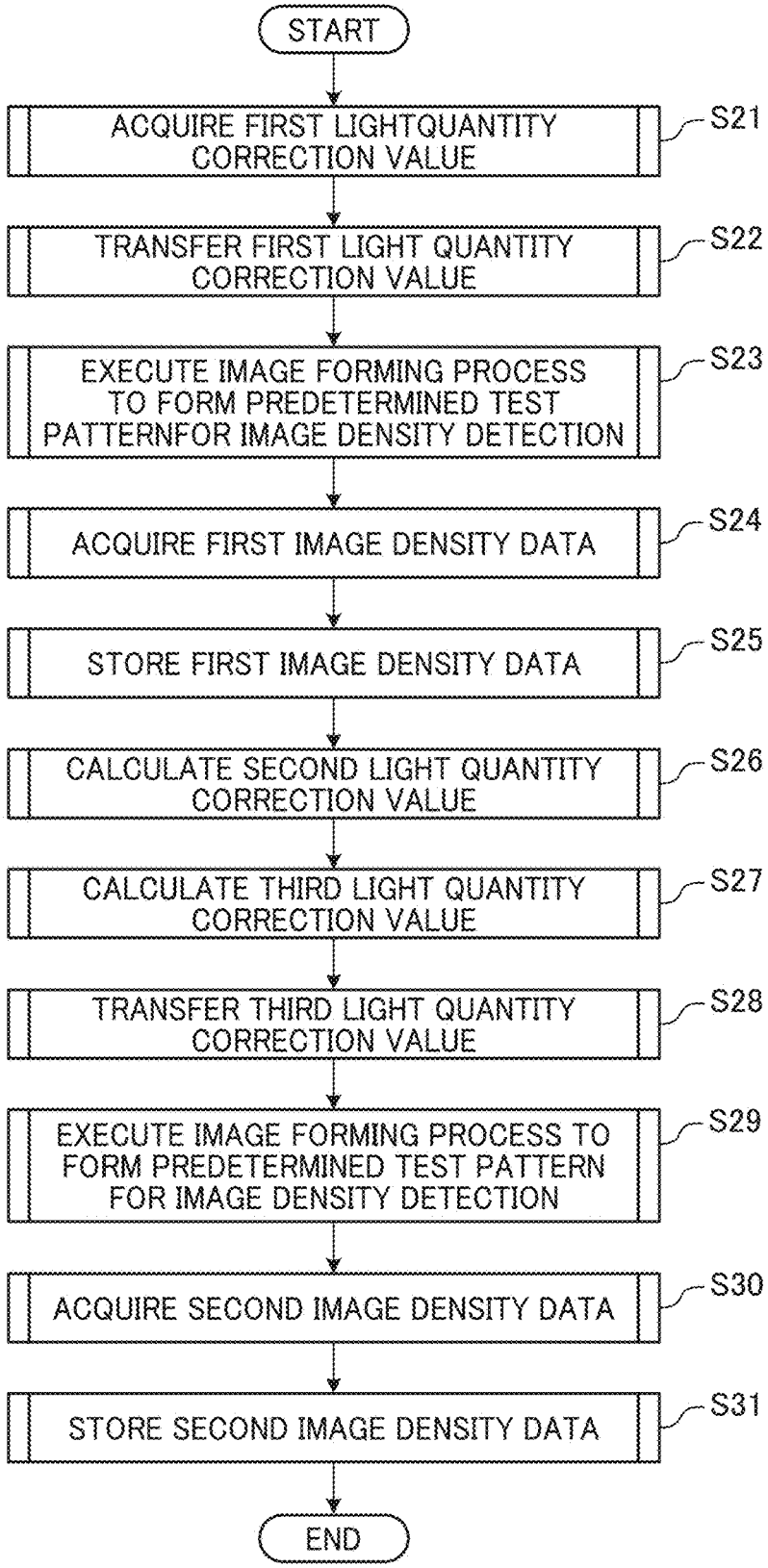
FIG. 12A is a flow chart of an image density unevenness acquisition in the main scanning direction that is a part of image density unevenness correction in the main scanning direction of a variation.
Figure 12B:
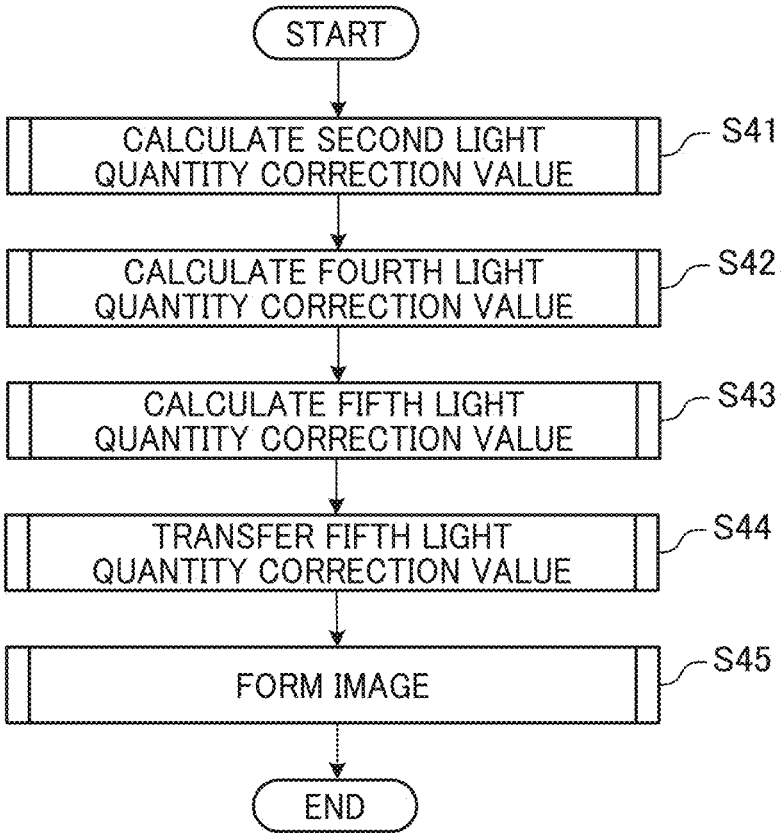
FIG. 12B is a flow chart of an image formation control that is a part of image density unevenness correction in the main scanning direction of the variation.

FIGS. 12A and 12B are a flow chart of a variation of the image density unevenness correction in the main scanning direction. FIG. 12A is a flowchart of an image density unevenness acquisition in the main scanning direction, and FIG. 12B is a flow chart of a control in the image forming process.

In the variation, as illustrated in FIG. 12A, similarly to the embodiment described above, the memory 87 stores a first image density data, that is, an image density data of the test pattern 171 formed based on the first light quantity correction value (step S21 to S25). Next, similarly to the embodiment described above, the calculator 82 calculates the third light quantity correction value based on the second light quantity correction value calculated based on the first image density data and the first light quantity correction value (step S26 to S27). Next, based on the calculated third light quantity correction value, the test pattern 171 is again formed on the sheet S, the test pattern 171 formed on the sheet S is read by the scanner 60, and the read data is stored in the memory 87 as a second image density data (step S28 to S31).

When the image forming apparatus forms an image, the light quantity correction calculator 88 calculates the second light quantity correction value based on the first image density data stored in the memory 87 (step S41). Next, based on the second image density data stored in the memory 87, a fourth light quantity correction value is calculated (step S42). Next, the calculator 82 calculates a fifth light quantity correction value by adding the first light quantity correction value, the second light quantity correction value, and the fourth light quantity correction value (step S43). Then, based on this fifth light quantity correction value, an image is formed (step S44 to S45).

In this variation, it is possible to decrease the image density unevenness in the main scanning direction which cannot be eliminated by the third light quantity correction value in the embodiment described above, and it is possible to further improve the image density unevenness in the main scanning direction.

A shock jitter may occur in the test pattern 171 formed on the sheet S illustrated in FIG. 8.

Figure 13:
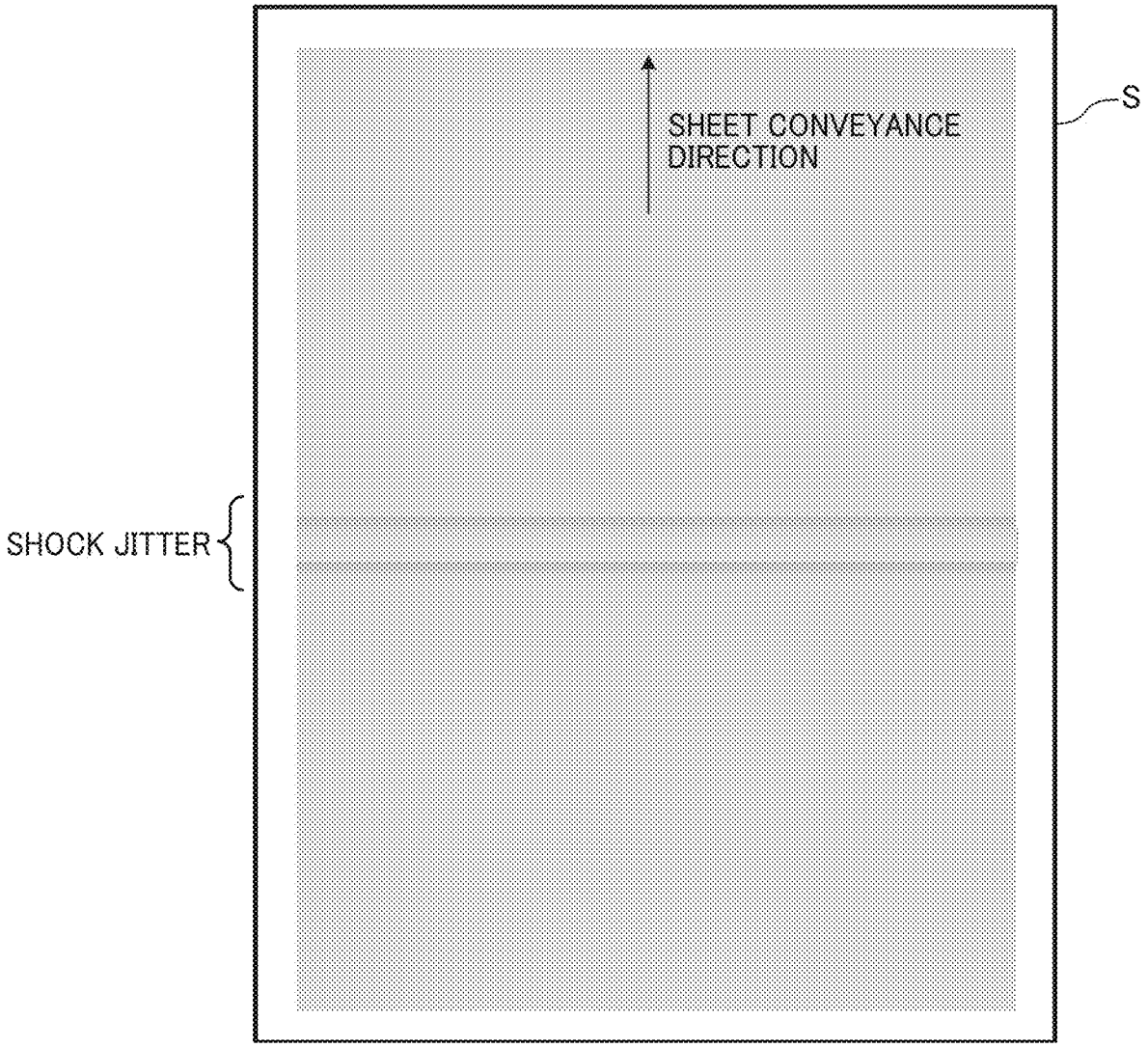
FIG. 13 is an explanatory diagram illustrating shock jitter occurring on an image on the sheet.

FIG. 13 is an explanatory diagram illustrating the shock jitter occurring on an image on a sheet.

As illustrated in FIG. 13, shock jitter is a horizontal streak extending in the sub-scanning direction. Shock jitter occurs, for example, due to an impact on the image forming apparatus that causes the image forming apparatus to vibrate during the imaging forming process. Such vibration causes, for example, vibration of the photoconductor 1 in a rotation direction, which results in sudden speed fluctuation of the photoconductor 1. Vibration during the image transfer from the photoconductor 1 to the sheet S disturbs the transfer and causes image density unevenness in the sub scanning direction. The above-described vibrations cause vibrations in the axial direction in the photoconductor 1, that is, the main scanning direction, causing image blurring and the image density unevenness in the main scanning direction. The shock jitter in the test pattern 171 makes it impossible to accurately acquire the image density unevenness in the main scanning direction. As a result, high-accuracy light quantity correction cannot be performed, and the image density unevenness in the main scanning direction may remain even after the light quantity correction.

The shock jitter often occurs due to vibrations generated when the sheet S passes through the conveyance members to convey the sheet S and enters the conveyance members. As the thickness of the sheet S becomes thicker, the shock generated when the sheet S passes through or enters the conveyance member becomes larger, and the shock jitter increases. Recently, increase of demands for use of various kinds of paper and reduction in rigidity of the entire image forming apparatus caused by weight reduction of the image forming apparatus makes the shock jitter generated at the timing at which the sheet S passes through and enters the conveyance members as a big design task. Reinforcement against the shock may not be a sufficient measure or may increase manufacturing cost.

Figure 14:
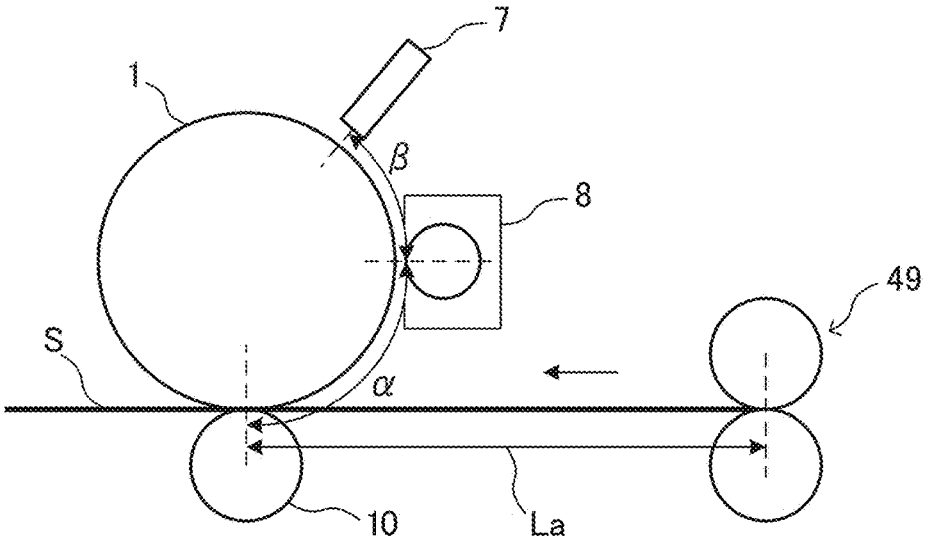
FIG. 14 is an explanatory diagram illustrating a state in which a trailing edge of the sheet in a conveyance direction passes between registration rollers.

FIG. 14 is an explanatory diagram illustrating a state in which a trailing edge of the sheet S in the conveyance direction passes through the registration rollers 49.

When the trailing edge of the sheet S in the conveyance direction passes through a nip of the registration rollers 49, the shock is generated. The shock is transmitted to the image forming engine including the photoconductor 1, and vibration of the photoconductor 1 affects the transfer to the sheet S, causing the image on the sheet S to blur and occur the shock jitter. When the conveyance distance of the sheet S from the nip of the registration rollers 49 to the transfer nip as the transfer position where the transfer roller 10 contacts the photoconductor 1 is La, the shock jitter occurs at a position at the distance La from the trailing edge of the sheet S.

The shock jitter generated when the trailing edge of the sheet in the conveyance direction passes through the conveyance member occurs at the position of the conveyance distance from the conveyance member which the trailing edge of the sheet passes through to the transfer position from the trailing edge of the sheet in the conveyance direction. However, when the bending of the sheet S is set between the conveyance member and the transfer nip, the position of the shock jitter is the position of the conveyance distance plus the bending length of the sheet from the trailing edge of the sheet. The conveyance member is a member that gives conveyance force to the sheet S, such as the feed roller 35, the feed relay rollers 41, the registration rollers 49, the transfer roller 10, the fixing roller 44*a*, sheet ejection relay rollers 43, and the sheet ejection rollers 46.

The shock jitter caused in the development region due to the vibration of the photoconductor 1 and the developing roller 8*a* when the trailing edge of the sheet in the conveyance direction passes through the registration rollers occurs at a distance La−α (α: a distance that the surface of the photoconductor 1 moves from the development region to the transfer nip) from the trailing edge of the sheet toward the leading edge of the sheet. The shock jitter caused in the latent image forming position due to the vibration of the photoconductor 1 and the latent image writing device 7 when the trailing edge of the sheet in the conveyance direction passes through the registration rollers occurs at a distance La−α−β (β: a distance that the surface of the photoconductor 1 moves from the latent image forming position to the development region) from the trailing edge of the sheet toward the leading edge of the sheet. When the bending of the sheet S is set between the registration rollers and the transfer nip, the above described positions of the shock jitter is the positions of the above described distance plus the bending length of the sheet from the trailing edge of the sheet.

Figure 15:
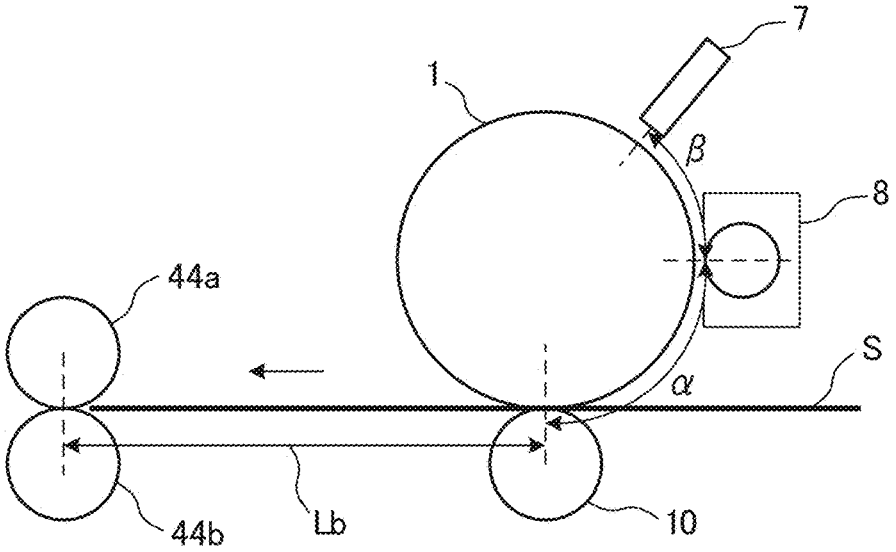
FIG. 15 is an explanatory diagram illustrating a state in which a leading edge of the sheet in the conveyance direction enters a fixing nip.

FIG. 15 is an explanatory diagram illustrating a state in which a leading edge of the sheet S in a conveyance direction enters the fixing nip.

When the leading edge of the sheet S in the conveyance direction enters the fixing nip, the shock is generated. The shock causes the image being transferred to the sheet S to blur, and the shock jitter occurs. When the conveyance distance of the sheet S from the transfer nip to the fixing nip is Lb, the shock jitter occurs at the distance Lb from the leading edge of the sheet S. The shock jitter generated when the leading edge of the sheet in the conveyance direction enters the conveyance member occurs at the position of the conveyance distance from the transfer position to a nip of the conveyance member which the leading edge of the sheet enters from the leading edge of the sheet in the conveyance direction. However, when the bending of the sheet S is set between the conveyance member and the transfer nip, the position of the shock jitter is the position of the conveyance distance plus the bending length of the sheet from the leading edge of the sheet.

The shock jitter caused in the development region due to the vibration of the photoconductor 1 and the developing roller 8*a* when the leading edge of the sheet in the conveyance direction enters the fixing roller 44*a* occurs at a distance La+α (α: a distance that the surface of the photoconductor 1 moves from the development region to the transfer nip) from the leading edge of the sheet. The shock jitter caused in the latent image forming position due to the vibration of the photoconductor 1 and the latent image writing device 7 when the leading edge of the sheet in the conveyance direction enters the fixing roller 44*a* occurs at a distance La+α+β(β: a distance that the surface of the photoconductor 1 moves from the latent image forming position to the development region) from the leading edge of the sheet. When the bending of the sheet S is set between the fixing roller 44*a* and the transfer nip, the above described positions of the shock jitter is the positions of the above described distance plus the bending length of the sheet.

As illustrated in FIGS. 14 and 15, a configuration of a conveyance path determines the timing at which the sheet S enters the conveyance member and the timing at which the sheet S passes through the conveyance member. In addition, a length of the conveyed sheet S in the sub-scanning direction determines the position of the shock jitter generated when the sheet passes through the conveyance member and the position of the shock jitter generated when the sheet enters the conveyance member. Therefore, in the present embodiment, based on the length of the conveyed sheet S in the sub-scanning direction that is the conveyance direction, a position of the test pattern 171 on the sheet S in the sub-scanning direction is changed. This avoids occurrence of the shock jitter in the test pattern 171.

In the configuration of the image forming apparatus in which the vibration hardly affects the developing area and the latent image forming position, the shock jitter hardly occurs. Therefore, the position of the test pattern may be determined based on the configuration of the image forming apparatus and which one of shock jitter occurring at the transfer nip, shock jitter occurring at the developing area, and shock jitter occurring at the latent image forming position should be avoided.

Figure 16:
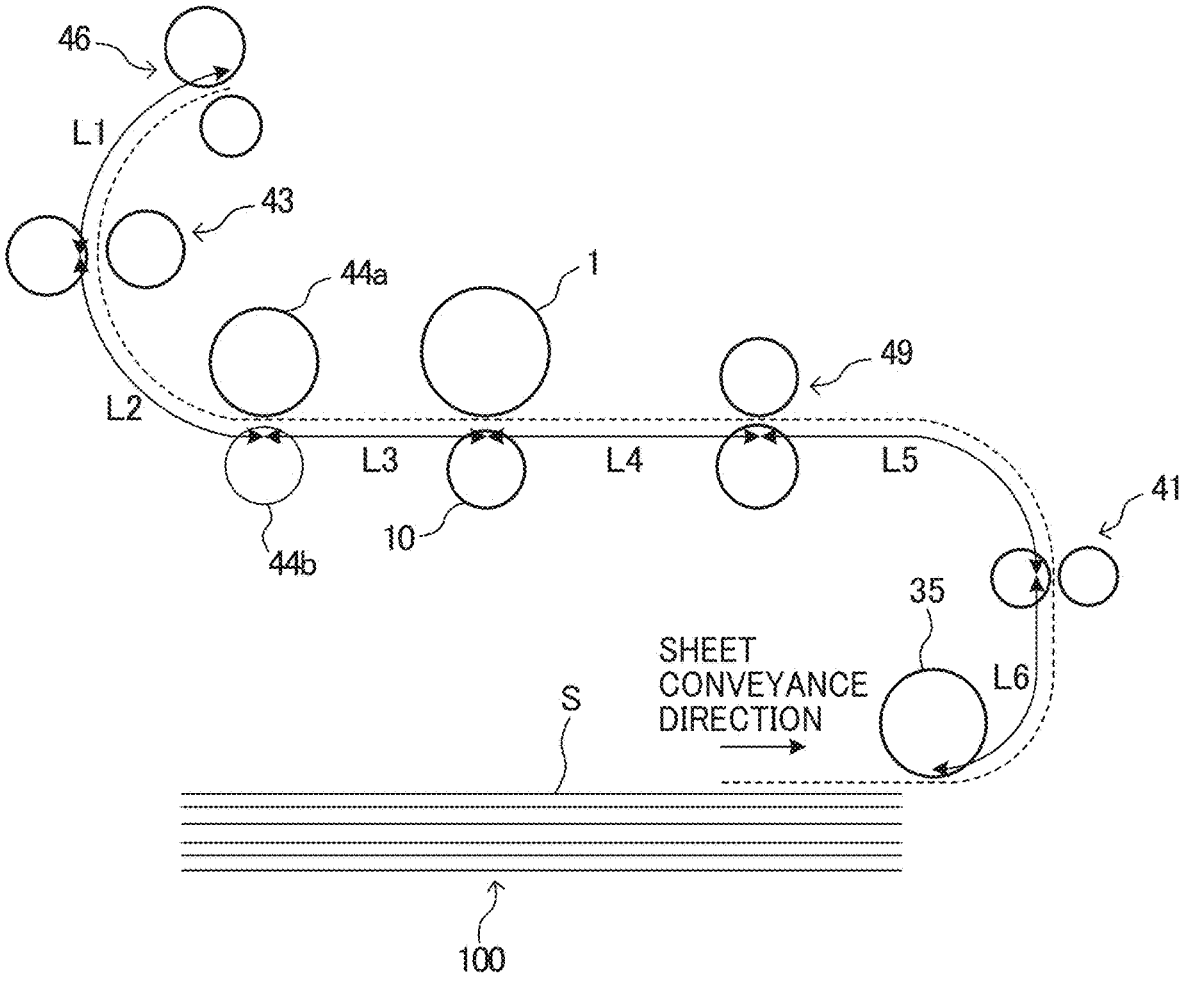
FIG. 16 is an explanatory diagram illustrating a conveyance distance between conveyance members that convey the sheet in the image forming apparatus of the present embodiment.
Figure 17:
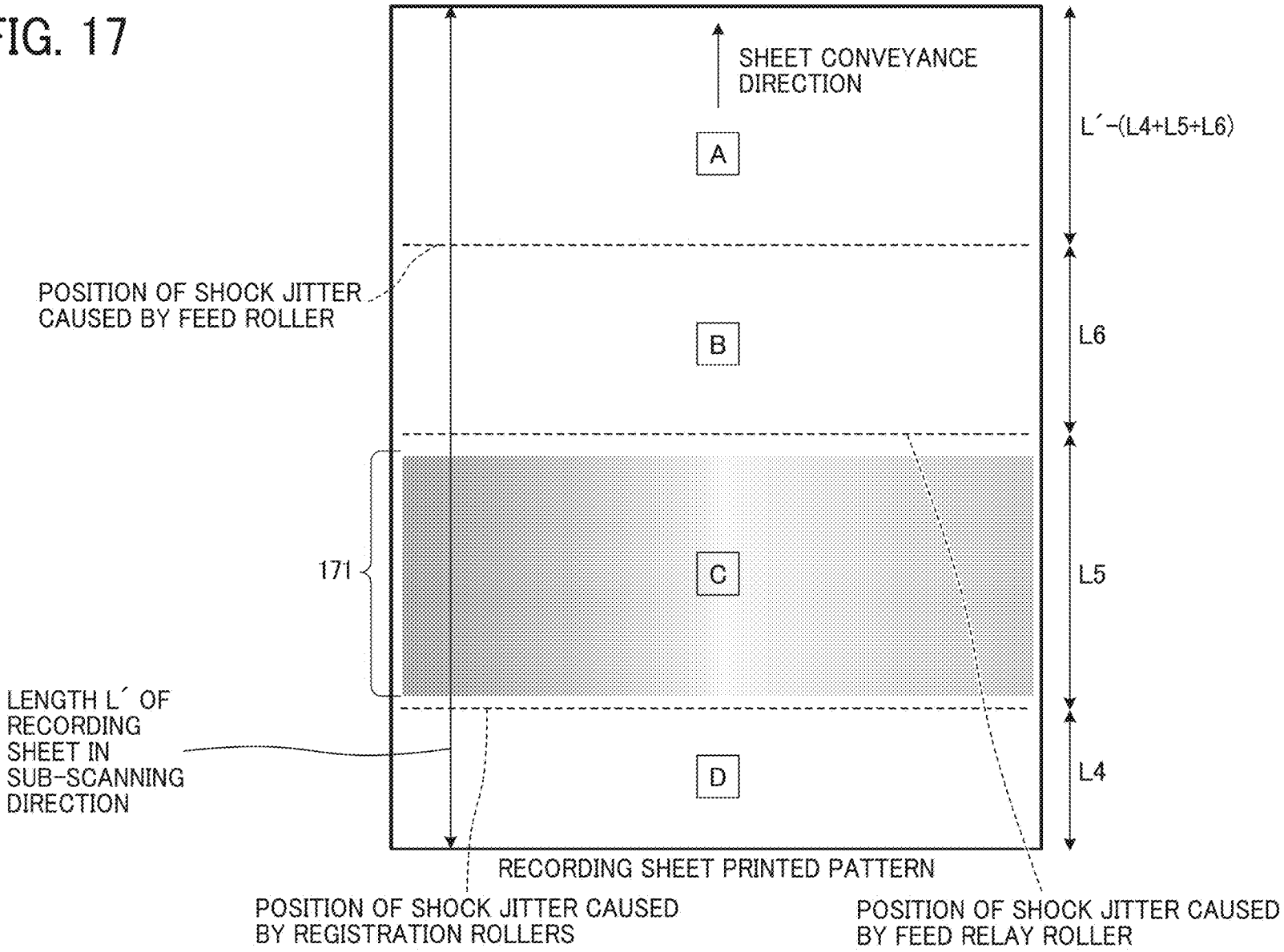
FIG. 17 is an explanatory diagram illustrating a test pattern arrangement in the present embodiment.

FIG. 16 is an explanatory diagram illustrating a conveyance distance between conveyance members that convey the sheet S in the image forming apparatus. FIG. 17 is an explanatory diagram illustrating a test pattern arrangement in the present embodiment. A position of the test pattern 171 in FIG. 17 is set because the shock jitter that occurs at a transfer position when the trailing edge of the sheet S in the conveyance direction passes through the conveyance members.

As illustrated in FIG. 16, in an arrangement of the conveyance members, that is, the feed roller 35, the feed relay rollers 41, the registration rollers 49, the transfer roller 10, the fixing roller 44*a*, the sheet ejection relay rollers 43, and the sheet ejection rollers 46, the shock jitter caused by the registration rollers 49, that is, the shock jitter that occurs when the trailing edge of the sheet S in a conveyance direction passes through the registration rollers 49 occurs at a position advanced by a distance L4 that is a distance between the registration rollers 49 and the transfer roller 10 on the record sheet S with reference to the trailing edge of the sheet S as illustrated in FIG. 17. The shock jitter caused by the feed relay rollers 41, that is, the shock jitter that occurs when the trailing edge of the sheet S in the conveyance direction passes through the feed relay rollers 41 occurs at a position advanced by a distance L4+L5 that is a distance between the feed relay rollers 41 and the transfer roller 10 on the sheet S with reference to the trailing edge of the sheet S. The shock jitter caused by the feed roller 35, that is, the shock jitter that occurs when the trailing edge of the sheet S in the conveyance direction passes through the feed relay rollers 41 occurs at a position advanced by a distance L4+L5 that is a distance between the feed relay rollers 41 and the transfer roller 10 on the sheet S with reference to the trailing edge of the sheet S.

When the length of the sheet S in the conveyance direction is L', the length from the leading edge of the sheet S in the conveying direction to the position of the shock jitter when the trailing edge of the sheet S passes through the feed roller 35 becomes L'−(L4+L5+L6).

The image forming processor 84 divides the sheet S into four sections that are a section A from the leading edge of the sheet S in the conveyance direction to the position of the shock jitter that occurs when the trailing edge of the sheet S in the conveyance direction passes through the feed roller 35, which has a length L'−(L4+L5+L6), a section B from the position of the shock jitter that occurs when the trailing edge of the sheet S passes through the feed roller 35 to the position of the shock jitter that occurs when the trailing edge of the sheet S passes through the feed relay roller, which has a length L6, a section C from the position of the shock jitter that occurs when the trailing edge of the sheet S passes through the feed relay roller to the position of the shock jitter that occurs when the trailing edge of the sheet S passes through the registration rollers, which has a length L5, and a section D from the position of the shock jitter that occurs when the trailing edge of the sheet S passes through the registration rollers to the trailing edge of the sheet S, which has a length L4. The image forming processor 84 sets the position for forming the test pattern 171 in the broadest section of the above four sections A to D.

Setting the test pattern position in one of any sections A to D divided the sheet S based on the locations of the shock jitter on the sheet S prevents an occurrence of the shock jitter that occurs when the trailing edge of the sheet S passes through the conveyance member such as the feed roller 35, the feed relay rollers 41, and the registration rollers 49. Setting the test pattern position in the broadest section of the divided sections A to D in the sub-scanning direction enables the length of the test pattern 171 in the sub-scanning direction to be longest without the occurrence of the shock jitter in the test pattern 171. In the test pattern 171 which is long in the sub-scanning direction, even when the image density fluctuates in the sub-scanning direction, averaging of the image density fluctuation makes it possible to reduce the influence of the image density fluctuation in the sub-scanning direction. In FIG. 17, since the section C from the position of the shock jitter that occurs when the trailing edge of the sheet S passes through the feed relay roller to the position of the shock jitter that occurs when the trailing edge of the sheet S passes through the registration rollers is broadest, the image forming processor 84 forms the test pattern 171 in the section C.

After setting the test pattern position in one of the above described sections, the image forming processor 84 sets a length of the test pattern 171 in the sub-scanning direction so that the test pattern 171 fits within the broadest section. Specifically, the image forming processor 84 sets the length of the test pattern 171 in the sub-scanning direction equal to or less than a length of the broadest section in the sub-scanning direction. This setting prevents the test pattern 171 from crossing the position of the shock jitter and appearance of the shock jitter in the test pattern 171.

The arrangement of each roller specific to the image forming apparatus determines the length of the sections B to D in the sub scanning direction as a fixed value specific to the image forming apparatus. However, since the length L' in the sub-scanning direction of the sheet S to form the test pattern may change, the length (L'−(L4+L5+L6)) of the section A in the sub-scanning direction may change according to the length L' in the sub-scanning direction of the sheet S. Therefore, in reality, the image forming processor 84 compares the length of the section A in the sub-scanning direction that is the length (L'−(L4+L5+L6)) with the longest section in the sub-scanning direction out of the sections B to D that is the length L5 of section C in the example of FIG. 17, set the position of the test pattern 171 to the section C when L5>(L'−(L4+L5+L6)), and set the position of the test pattern 171 to the section A when L5<(L'−(L4+L5+L6)).

The image forming processor 84 may obtain the length L' of the sheet S in the sub-scanning direction, for example, from the memory 87 that stores data input by the user. The user may input size data of the sheet S to the control panel 89 (see FIG. 5) when the user sets the sheet S in the sheet tray 100, and the memory 87 stores the size data input by the user. That is, in the present embodiment, the control panel 89 (see FIG. 5) and the like function as the length data acquisition unit.

The image forming processor 84 specifies the sheet length in the main scanning direction from the size data of the sheet S stored in the memory 87. When the length of the sheet S in the main scanning direction is shorter than the longest sheet length in the main scanning direction in which the image forming apparatus can form the image, the image forming processor controls the control panel 89 to display an instruction to set a sheet having the longest sheet length in the main scanning direction in which the image forming apparatus can form the image in the sheet tray 100. When the sheet having the longest sheet length in the main scanning direction in which the image forming apparatus can form the image is set in the sheet tray 100, the image forming processor may start the formation of the test pattern 171. This enables formation of the test pattern 171 as long as possible and corrects the image density unevenness at ends in the main scanning direction.

When the test pattern 171 is formed on the sheet S having the length L in the sub-scanning direction shorter than (L4+L5+L6), and the trailing edge of the sheet S pass through the feed roller 35, the leading edge of the sheet S does not reach the transfer position. Therefore, the shock jitter does not occur at the transfer position when the trailing edge of the sheet S passes through the feed roller 35. As a result, in the image formed on the sheet S, there are the shock jitter that occurs when the trailing edge of the sheet S passes through the feed relay roller and the shock jitter that occurs when the trailing edge of the sheet S passes through the registration rollers. That is, in this case, as illustrated in FIG. 17, the shock jitter appears at a position advanced from the trailing edge in the conveyance direction of the sheet S to the leading edge by L4 and at a position advanced from the trailing edge in the conveyance direction of the sheet S to the leading edge by (L4+L5). Therefore, when the test pattern 171 is formed on the sheet S having the length L in the sub-scanning direction shorter than (L4+L5+L6), the image forming processor 84 divides the sheet S into three sections that are the section A that has a length L'−(L4+L5) in the sub-scanning direction from the leading edge of the sheet S in the conveyance direction, the section B that has the length L5 in the sub-scanning direction from the leading edge of the sheet S in the conveyance direction, and the section C that has the length L4 in the sub-scanning direction from the leading edge of the sheet S in the conveyance direction. The image forming processor 84 sets the position of the test pattern 171 so that the test pattern 171 is formed in the longest section in the sub-scanning direction among the sections A to C.

In the image on the sheet S having the length L' in the sub-scanning direction shorter than L4+L5, the shock jitter that occurs the image density unevenness in the main scanning direction occurs only at the position advanced by L4 form the trailing edge of the sheet S in the conveyance direction. Therefore, the image forming processor 84 divides the sheet S into two sections that are the section A that has a length L'−L4 in the sub-scanning direction from the leading edge of the sheet S in the conveyance direction, the section B that has the length L4 in the sub-scanning direction from the leading edge of the sheet S in the conveyance direction. The image forming processor 84 sets the position of the test pattern 171 so that the test pattern 171 is formed in the longest section in the sub-scanning direction among the sections A and B.

As described above, adjustment of the position of the test pattern 171 based on the length L' of the sheet S in the sub-scanning direction prevents the occurrence of the shock jitter in the test pattern, and enables to set the length of the test pattern 171 in the sub-scanning direction as long as possible. This makes it possible to accurately obtain the image density unevenness in the main scanning direction.

Figure 18:
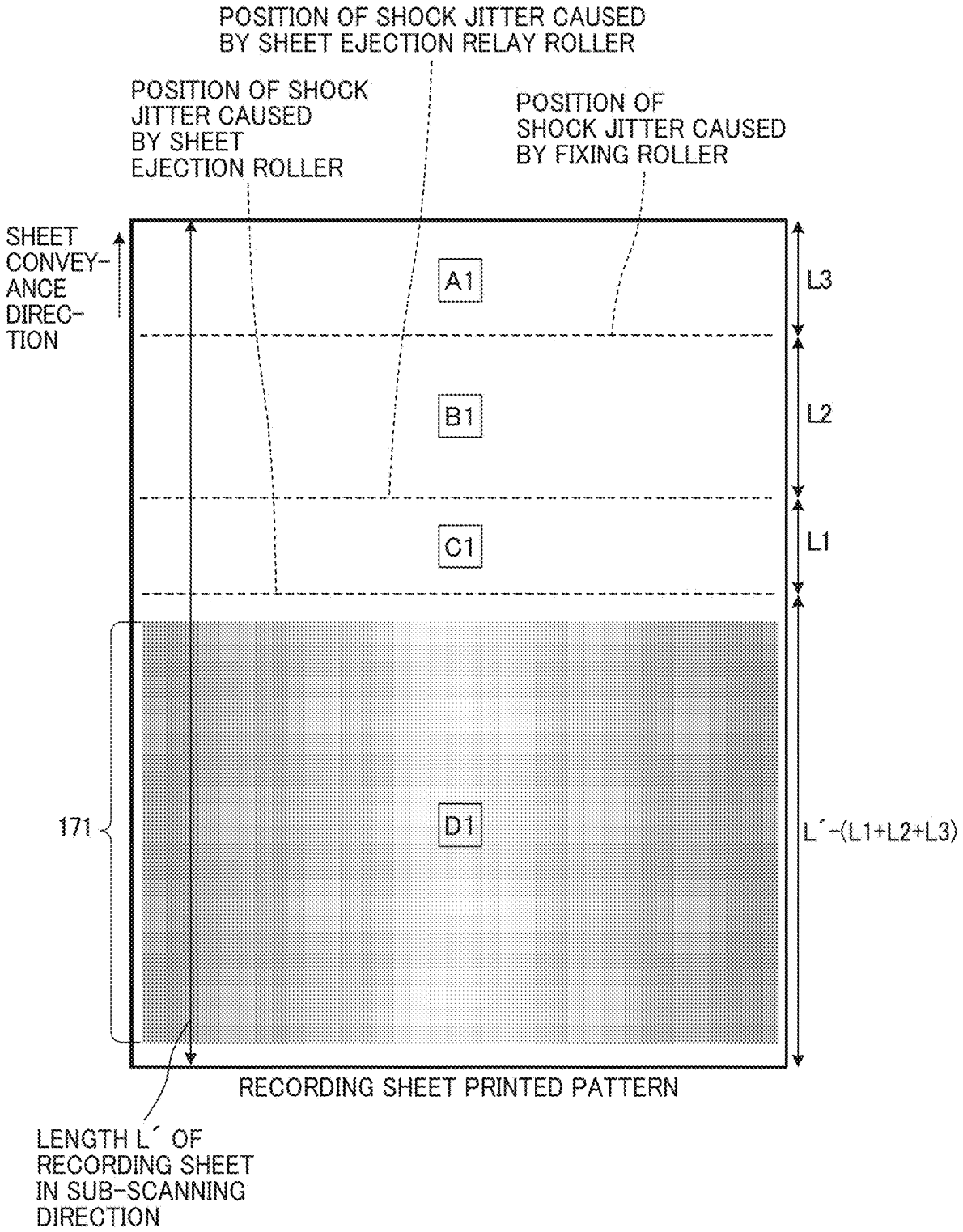
FIG. 18 is an explanatory diagram illustrating an example of a test pattern formed based on locations of shock jitter that occur when the leading edge of the sheet enters the conveyance members.

FIG. 18 is an explanatory diagram illustrating an example of the test pattern formed based on locations of shock jitter that occur when the leading edge of the sheet S enters conveyance members.

A position of the test pattern 171 in FIG. 18 is also set because the shock jitter occurs at the transfer position when the leading edge of the sheet S in the conveyance direction enters the conveyance members.

When the length L of the sheet S in the sub-scanning direction is equal to or longer than the conveyance distance from the transfer roller 10 to the sheet ejection rollers 46 that is L1+L2+L3 in FIG. 16, as illustrated in FIG. 18, shock jitter occurs when the leading edge of the sheet in the conveyance direction enters the fixing roller 44*a*, the sheet ejection relay rollers 43, and the sheet ejection rollers 46, and appear in the image on the sheet S.

The shock jitter caused by the fixing roller 44*a*, that is, the shock jitter that occurs when the leading edge of the sheet S in the conveyance direction enters the fixing roller 44*a* occurs at a position advanced by a distance L3 that is a distance between the fixing roller 44*a* and the transfer roller 10 on the sheet S with reference to the leading edge of the sheet S. The shock jitter caused by the sheet ejection relay rollers 43, that is, the shock jitter that occurs when the leading edge of the sheet S in the conveyance direction enters the sheet ejection relay rollers 43 occurs at a position advanced by a distance (L3+L2) that is a distance between the sheet ejection relay rollers 43 and the transfer roller 10 on the sheet S with reference to the leading edge of the sheet S. The shock jitter caused by the sheet ejection rollers 46, that is, the shock jitter that occurs when the leading edge of the sheet S in the conveyance direction enters the sheet ejection rollers 46 occurs at a position advanced by a distance (L3+L2+L1) that is a distance between the sheet ejection rollers 46 and the transfer roller 10 on the sheet S with reference to the leading edge of the sheet S.

Therefore, based on the data of the length L' in the sub-scanning direction of the sheet S acquired by the control panel 89 and the conveyance distances between the conveying members, the image forming processor 84 divides the sheet S into four sections that are a section A1 from the leading edge of the sheet S to the position of the shock jitter that occurs when the leading edge of the sheet S enters the fixing roller 44*a*, which has a length L3, a section B1 from the position of the shock jitter that occurs when the leading edge of the sheet S enters the fixing roller 44*a* to the position of the shock jitter that occurs when the leading edge of the sheet S enters the sheet ejection relay rollers 43, which has a length L2, a section C1 from the position of the shock jitter that occurs when the leading edge of the sheet S enters the sheet ejection relay rollers 43 to the position of the shock jitter that occurs when the leading edge of the sheet S enters the sheet ejection rollers 46, which has a length L1, a section D1 from the position of the shock jitter that occurs when the leading edge of the sheet S enters the sheet ejection rollers 46 to the trailing edge of the sheet S in the conveyance direction, which has a length L'−(L1+L2+L3). The image forming processor 84 sets the position for forming the test pattern 171 in the broadest section of the above four sections A1 to D1. In FIG. 18, the image forming processor 84 forms the test pattern 171 in the section D1. Further, the image forming processor 84 sets the length of the test pattern in the sub-scanning direction to be equal to or less than the length of the section for the test pattern in the sub scanning direction.

This enables the length of the test pattern 171 in the sub-scanning direction to be longest without the occurrence of the shock jitter in the test pattern 171 that occurs when the leading edge of the sheet S enters the conveyance rollers.

The arrangement of each roller specific to the image forming apparatus determines the length L1, L2, and L3 as fixed values and, therefore, determines the length of the sections A1 to C1 in the sub scanning direction as a fixed value specific to the image forming apparatus. On the other hand, the length (L'−(L1+L2+L3)) of the section D1 in the sub-scanning direction may change according to the length L' in the sub-scanning direction of the sheet S. Therefore, in reality, the image forming processor 84 compares the length of the section D1 in the sub-scanning direction that may change according to the length of the sheet S with the longest section in the sub-scanning direction out of the sections A1 to C1, which is the length of the section B1 in the example of FIG. 17, and determines the position in which the test pattern 171 is formed.

When the sheet S has the length L' in the sub-scanning direction shorter than (L1+L2+L3) and equal to or longer than (L2+L3), since the shock jitter does not occur when the leading edge of the sheet S enters the sheet ejection rollers 46, the image forming processor 84 divides the sheet S into three sections that are the section whose length in the sub-scanning direction is L3, the section whose length in the sub-scanning direction is L2, and the section whose length in the sub-scanning direction is L'−(L3+L2). The image forming processor 84 sets the position of the test pattern 171 so that the test pattern 171 is formed in the longest section in the sub-scanning direction among the three sections.

Figure 19:
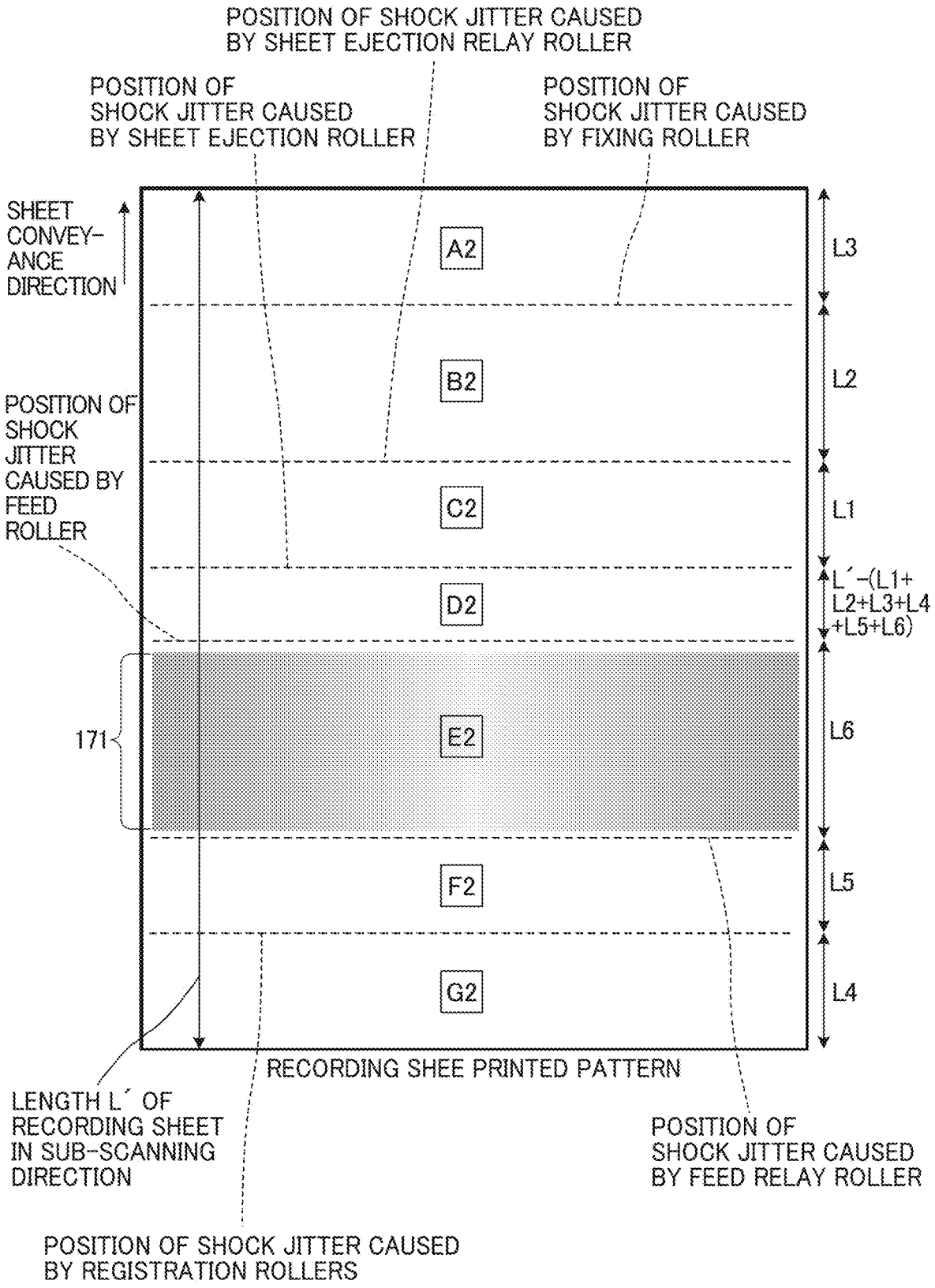
FIG. 19 is an explanatory diagram illustrating an example of a test pattern formed based on locations of shock jitter that occur when the leading edge of the sheet enters between conveyance rollers and locations of shock jitter that occur when the trailing edge of the sheet passes through conveyance rollers.

When the sheet S has the length L' in the sub-scanning direction shorter than (L2+L3), since the shock jitter occurs only when the leading edge of the sheet S enters the fixing roller 44*a*, the image forming processor 84 divides the sheet S into two sections that are the section whose length in the sub-scanning direction is L3 and the section whose length in the sub-scanning direction is L'−L3 and sets the position of the test pattern 171 so that the test pattern 171 is formed in the longest section in the sub-scanning direction of the two sections. FIG. 19 is an explanatory diagram illustrating an example of a test pattern formed based on locations of shock jitter that occur when the leading edge of the sheet S enters between conveyance members and locations of shock jitter that occur when the trailing edge of the sheet S passes through conveyance members.

A position of the test pattern in FIG. 19 is set because the shock jitter occurs at a transfer position when the leading edge and the trailing edge of the sheet S having the length L' in the sub-scanning direction longer than a sheet conveyance distance in the image forming apparatus, that is, L'>L1+L2+L3+L4+L5+L6 enters and passes through passes through the conveyance members.

In the example illustrated in FIG. 19, like the above described examples, the length L' in the sub-scanning direction of the sheet and the conveyance distances L1, L2, L3, L4, L5, L6 between the respective rollers determine the location of the shock jitter on the sheet S in the sub-scanning direction. As illustrated in FIG. 19, based on the length L' in the sub-scanning direction of the sheet and the conveyance distances L1, L2, L3, L4, L5, L6 between the respective rollers, the image forming processor 84 divides the sheet S into seven sections that are A2 to G2 in FIG. 19. The image forming processor 84 sets the position of the test pattern so that the test pattern is formed in the longest section in the sub-scanning direction among the seven sections A2 to G2 and sets the length of the test pattern in the sub-scanning direction so that the test pattern fits within the longest section.

When the length L' of the sheet in the sub-scanning direction is short, for example, the shock jitter that occurs when the trailing edge of the sheet pass through the feed roller 35 may position between the shock jitter that occurs when the leading edge of the sheet enters the fixing roller and the shock jitter that occurs when the leading edge of the sheet enters the sheet ejection relay rollers 43. When the image forming processor 84 divides the sheet based on the position of the shock jitters, this leads to a short length of the divided section in the sub-scanning direction. Therefore, preferably, the sheet on which the test pattern 171 is formed is long in the sub-scanning direction as much as possible.

Shock jitter may occur at the development region and the latent image forming position other than at the transfer position when the leading edge of the sheet enters the conveyance members and the trailing edge of the sheet pass through the conveyance members. The position of the test pattern may be set considering all shock jitters. However, consideration of all the shock jitters may shorten the section of the sheet S, which is divided based on the position of the shock jitter, and results in too short length of the test pattern in the sub-scanning direction. Due to the rigidity of the image forming apparatus, etc., all shock jitters do not always occur. Therefore, preferably, the test pattern is formed based on the position of the shock jitter determined by experiments in which observation of output images specifies the positions at which the shock jitters prominently occur.

Next, an example of formation of the test pattern in a color image forming apparatus having a tandem-type intermediate transfer system is described.

Figure 20:
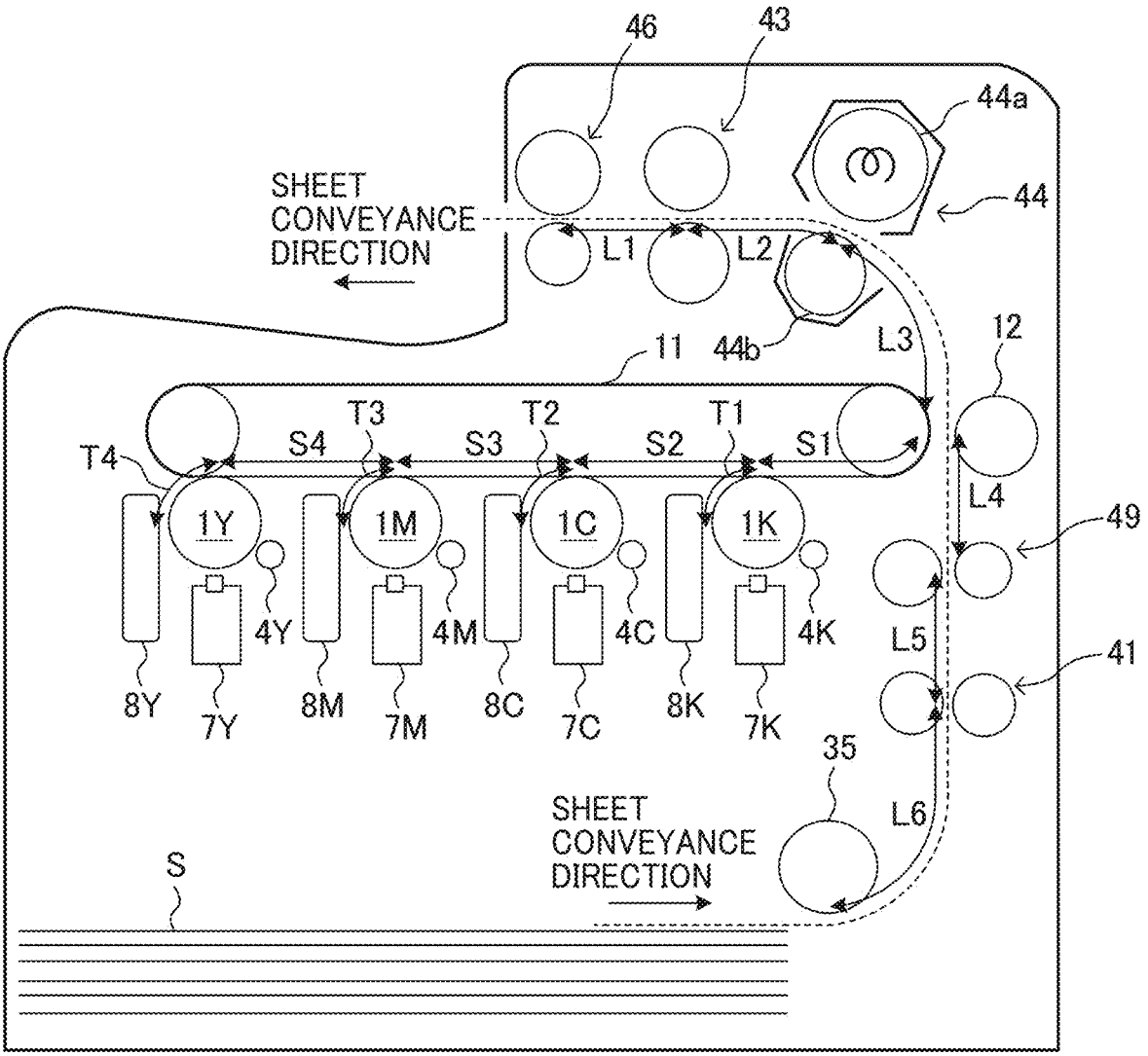
FIG. 20 is a schematic diagram illustrating a color image forming apparatus having a tandem-type intermediate transfer system.
Figure 21:
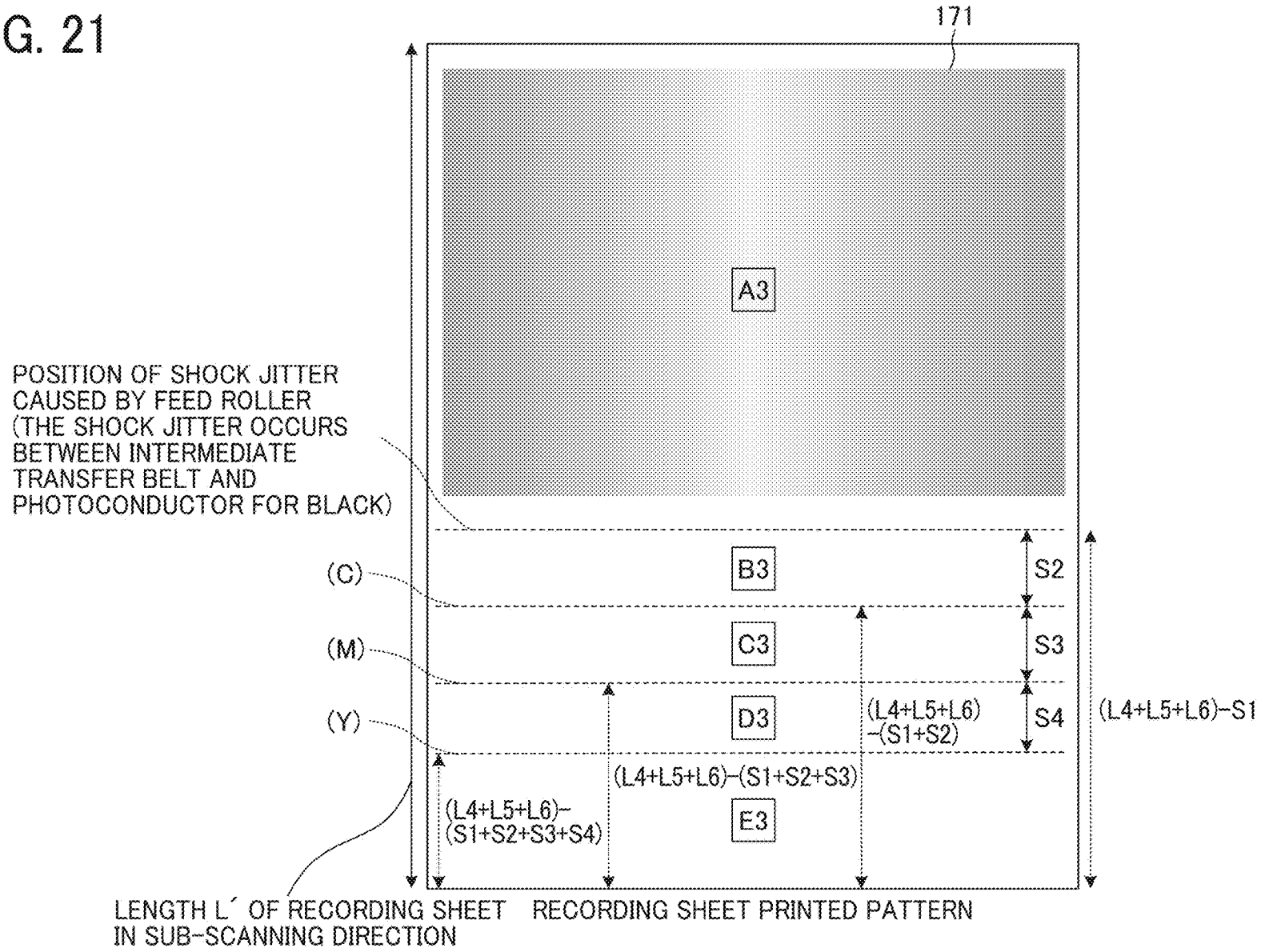
FIG. 21 is an explanatory diagram illustrating an example of a test pattern formed in the color image forming apparatus of FIG. 20.

FIG. 20 is a schematic diagram illustrating a color image forming apparatus having the tandem-type intermediate transfer system, and FIG. 21 is an explanatory diagram illustrating an example of a test pattern formed in the color image forming apparatus of FIG. 20.

In the examples illustrated in FIGS. 20 and 21, the test pattern 171 is formed because the shock jitter occurs in a primary transfer position of each color when the trailing end of the sheet S in the conveyance direction passes through the feed roller 35.

As illustrated in FIG. 20, the color image forming apparatus having the tandem type intermediate transfer system includes photoconductors 1Y, 1M, 1C, and 1K, charging rollers 4Y, 4M, 4C, and 4K, latent image writing devices 7Y, 7M, 7C, and 7K, and developing devices 8Y, 8M, 8C, and 8K, for a yellow, magenta, cyan and black toner image, respectively. Each color toner image formed on each photoconductor 1Y, 1M, 1C, 1K are primarily transferred from the photoconductor and superimposed on one another on the intermediate transfer belt 11. Thus, a multicolor toner image is formed on the intermediate transfer belt 11. The intermediate transfer belt 11 conveys the multicolor toner image to a secondary transfer position where the secondary transfer roller 12 faces the intermediate transfer belt 11. The secondary transfer roller secondarily transfers the multicolor toner image on the intermediate transfer belt 11 onto the sheet S conveyed to the secondary transfer roller to form the multicolor image on the sheet S.

The shock jitter that occurs at a primary transfer position where a black toner image is primarily transferred from the photoconductor for the black onto the intermediate transfer belt 11 when the trailing edge of the sheet S passes through the feed roller 35 is generated on the sheet S at a position distant from the trailing edge to the leading edge of the sheet in the conveyance direction by an amount obtained by subtracting a distance between the feed roller 35 and the secondary transfer roller 12, that is, (L4+L5+L6), from a distance S1 in which a surface of the intermediate transfer belt 11 moves from the primary transfer position for the black toner image to the secondary transfer position, that is, ((L4+L5+L6)−S1). The shock jitter that occurs at a primary transfer position of a cyan toner image is primarily transferred from the photoconductor for the cyan onto the intermediate transfer belt 11 when the trailing edge of the sheet S passes through the feed roller 35 is generated on the sheet S at a position distant from the trailing edge to the leading edge of the sheet in the conveyance direction by an amount obtained by subtracting a distance between the feed roller 35 and the secondary transfer roller 12, that is, (L4+L5+L6), from a distance S1+S2 in which a surface of the intermediate transfer belt 11 moves from the primary transfer position for the cyan toner image to the secondary transfer position, that is, ((L4+L5+L6)−(S1+S2)) as illustrated in FIG. 21. As illustrated in FIG. 20, S2 is a distance in which the intermediate transfer belt 11 moves from the primary transfer position for the black toner image to the primary transfer position for the cyan toner image.

Similarly, the shock jitter that occurs at a primary transfer position of a magenta toner image is primarily transferred from the photoconductor for the magenta onto the intermediate transfer belt 11 when the trailing edge of the sheet S passes through the feed roller 35 is generated on the sheet S at a position distant from the trailing edge to the leading edge of the sheet in the conveyance direction by an amount obtained by subtracting a distance between the feed roller 35 and the secondary transfer roller 12, that is, (L4+L5+L6), from a distance S1+S2+S3 in which a surface of the intermediate transfer belt 11 moves from the primary transfer position for the magenta toner image to the secondary transfer position, that is, ((L4+L5+L6)−(S1+S2+S3)). S3 is a distance in which the intermediate transfer belt 11 moves from the primary transfer position for the magenta toner image to the primary transfer position for the cyan toner image. The shock jitter that occurs at a primary transfer position of a yellow toner image is primarily transferred from the photoconductor for the yellow onto the intermediate transfer belt 11 when the trailing edge of the sheet S passes through the feed roller 35 is generated on the sheet S at a position distant from the trailing edge to the leading edge of the sheet in the conveyance direction by an amount obtained by subtracting a distance between the feed roller 35 and the secondary transfer roller 12, that is, (L4+L5+L6), from a distance S1+S2+S3+S4 in which a surface of the intermediate transfer belt 11 moves from the primary transfer position for the yellow toner image to the secondary transfer position, that is, ((L4+L5+L6)−(S1+S2+S3+S4)). S4 is a distance in which the intermediate transfer belt 11 moves from the primary transfer position for the yellow toner image to the primary transfer position for the magenta toner image.

As illustrated in FIG. 21, the image forming processor 84 divides the sheet S into five sections that are a section A3 from the leading edge of the sheet S in the conveyance direction to the position of the shock jitter that occurs at the primary transfer position for the black toner image, which has a length (L'−((L4+L5+L6)−S1))), a section B3 from the position of the shock jitter that occurs at the primary transfer position for the black toner image to the position of the shock jitter that occurs at the primary transfer position for the cyan toner image, which has a length S2, a section C3 from the position of the shock jitter that occurs at the primary transfer position for the cyan toner image to the position of the shock jitter that occurs at the primary transfer position for the magenta toner image, which has a length S3, a section D3 from the position of the shock jitter that occurs at the primary transfer position for the magenta toner image to the position of the shock jitter that occurs at the primary transfer position for the yellow toner image, which has a length S4, and a section E3 from the position of the shock jitter that occurs at the primary transfer position for the yellow toner image to the trailing edge of the sheet S in the conveyance direction, which has a length ((L4+L5+L6)−(S1+S2+S3+S4)). The image forming processor 84 sets the position for forming the test pattern in the broadest section of the above five sections A3 to E3, which is the section A3 in the case of FIG. 21. The image forming processor 84 sets the length of the test pattern in the sub-scanning direction so that the test pattern fits within the broadest section, that is, the section A3.

This enables the length of the test pattern in the sub-scanning direction to be longest without the occurrence of the shock jitter in the test pattern in the color image forming apparatus.

In the above example, the test pattern 171 is formed to avoid the shock jitter occurring in a primary transfer position of each color when the trailing end of the sheet S in the conveyance direction passes through the feed roller 35. In order to avoid the shock jitter occurring in a development region of each color when the trailing end of the sheet S in the conveyance direction passes through the feed roller 35, the test pattern 171 is formed as follows. A position of the shock jitter that occurs at the development region where the black toner image is developed on the photoconductor for the black when the trailing edge of the sheet S passes through the feed roller 35 is at a position distant from the trailing edge to the leading edge of the sheet in the conveyance direction by an amount obtained by subtracting above described distance (L4+L5+L6)−S1 from a distance T1 in which the photoconductor for the black moves from the development region to the primary transfer position, that is, ((L4+L5+L6)−S1−T1). Similarly, a position of the shock jitter that occurs at the development region where the cyan toner image is developed on the photoconductor for the cyan is at a position distant from the trailing edge to the leading edge of the sheet in the conveyance direction by an amount obtained by ((L4+L5+L6)−(S1+S2)−T2). A position of the shock jitter that occurs at the development region where the magenta toner image is developed on the photoconductor for the magenta is at a position distant from the trailing edge to the leading edge of the sheet in the conveyance direction by an amount obtained by ((L4+L5+L6)−(S1+S2+S3)−T3). A position of the shock jitter that occurs at the development region where the yellow toner image is developed on the photoconductor for yellow is at a position distant from the trailing edge to the leading edge of the sheet in the conveyance direction by an amount obtained by ((L4+L5+L6)−(S1+S2+S3+S4)−T4). The image forming processor 84 divides the sheet S into sections based on the above described locations of the shock jitter that occur at the development regions for four colors, sets the position for forming the test pattern 171 in the longest section in the sub-scanning direction, and sets a length of the test pattern 171 in the sub-scanning direction so that the test pattern 171 fits within the longest section.

As illustrated in FIG. 20, in the color image forming apparatus, a number of colors increases a number of the shock jitters. Therefore, preferably, the test pattern is formed based on the position of the shock jitter determined by experiments in which observation of output images specifies the positions at which the shock jitters prominently occur.

The latent image writing device 7 may also be an apparatus that optically scans the light of a light source such as an LED on the photoconductor 1 with a rotary deflector such as a polygon mirror to write the latent image on the photoconductor 1.

Figure 22:
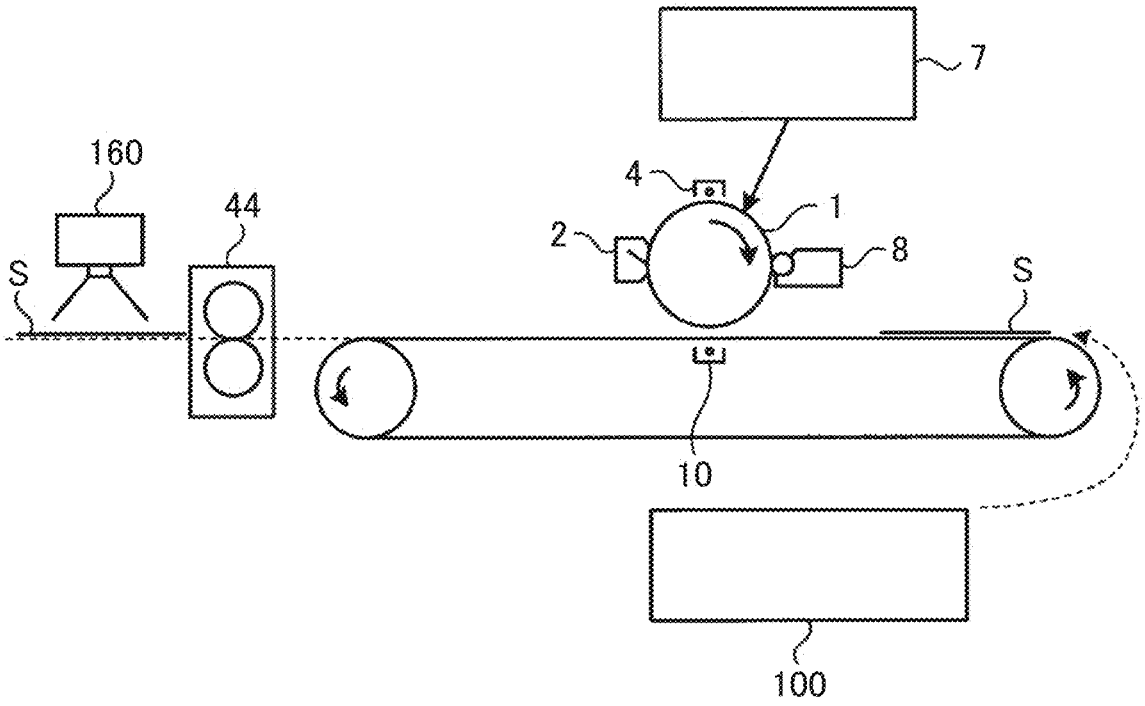
FIG. 22 is a schematic diagram illustrating an example of an image forming apparatus having an image reading device disposed on the conveyance path of the sheet.

As illustrated in FIG. 22, for example, the image forming apparatus may include an image reading sensor 160 such as an image sensor to read the test pattern 171 formed on the sheet S in the conveyance path of the sheet S. Specifically, the image reading sensor 160 is disposed in the conveyance path from the fixing device 44 to the sheet ejection roller. This has a merit that the user can eliminate a work of setting the sheet on which the test pattern is formed on the scanner 60.

The structures described above are just examples, and the various aspects of the present specification attain respective effects as follows.

Aspect 1

The image forming apparatus includes a latent image bearer such as the photoconductor 1, a latent image writing device 7 that exposes a surface of the latent image bearer to form a latent image on the latent image bearer, a developing device 8 to develop the latent image, a conveyance unit including the feed roller 35, the feed relay rollers 41, the registration rollers 49, the transfer roller 10, the fixing roller 44*a*, a sheet ejection relay rollers 43, and the sheet ejection rollers 46 to convey a recording medium; a transfer device such as the transfer roller 10 to transfer the image developed by the developing device 8 from the latent image bearer onto the recording medium such as the sheet S; a length data acquisition unit to obtain the length of the recording medium in the conveyance direction of the recording medium, which is the control panel 89 in the present embodiment; an image forming processor 84 to form a test pattern, and a light quantity correction calculator that acquires image density data of the test pattern formed on the recording medium and calculates a light quantity correction value to correct a light quantity with which the latent image writing device exposes the surface of the latent image bearer based on the acquired image density data, which is configured by the scanner 60, the image density acquiring unit 86, the light quantity correction calculator 88, and the calculator 82. The image forming processor 84 sets the position of the test pattern on the recording medium in the conveyance direction of the recording medium and the length of the test pattern in the conveyance direction of the recording medium based on the length of the recording medium in the conveyance direction of the recording medium obtained by the length data acquisition unit.

The applicant of the present disclosure earnestly studied factors which do not improve the image density unevenness in the main scanning direction even if the latent image writing device is controlled based on the light quantity correction value calculated from the image density data of the test pattern formed on the recording medium, and found the following. That is, the applicant found that the above described factor is a shock jitter that occurs in the test pattern formed on the recording medium and a calculation of the light quantity correction value based on the image density data of the test pattern including the shock jitter.

Such shock jitter occurs when the latent image bearer or the like vibrates due to impact generated when the trailing edge of the recording medium in the conveyance direction of the recording medium passes through the conveyance member. The timing when the recording medium passes through the conveyance member varies depending on the length of the recording medium in the conveyance direction of the recording medium. Therefore, a position influenced by the shock jitter in the image on the recording medium in the conveyance direction of the recording medium differs depending on the length of the recording medium in the conveyance direction of the recording medium.

In the first aspect, the length data acquisition unit obtains the length data of the recording medium in the conveyance direction of the recording medium which is set in the image forming apparatus, and the image forming processor sets the position of the test pattern and the test pattern length in the conveyance direction of the recording medium based on the obtained data of the length of the recording medium in the conveyance direction of the recording medium. This makes it possible to form the test pattern on the recording medium while avoiding the position in the conveyance direction of the recording medium where the image on the recording medium is affected by the shock jitter, and to prevent the occurrence of shock jitter in the test pattern. This enables to calculate the light quantity correction value with high accuracy based on the image density data of the test pattern and satisfactorily decrease the image density unevenness in the main scanning direction.

Aspect 2

In the aspect 1, the latent image writing device 7 includes a plurality of light emitting elements such as LEDs aligned in the main scanning direction and disposed facing the surface of the latent image bearer such as the photoconductor 1.

This latent image writing device 7 enables to correct the image density unevenness in the main scanning direction better, as compared with the case of writing the latent image by optically scanning the photoconductor 1 with a rotating deflector such as a polygon mirror.

Aspect 3

In the aspect 2, the light quantity correction calculator, which is configured by the scanner 60, the image density acquiring unit 86, the light quantity correction calculator 88, and the calculator 82, corrects the light quantity with which the latent image writing device 7 exposes the surface of the photoconductor 1 based on the first light quantity correction value corresponding to the characteristic of the latent image writing device 7, calculates the second light quantity correction value based on the image density data of the test pattern 171 formed on the sheet S using the first light quantity correction value, and calculates the light quantity correction value of aspect 1 based on the first light quantity correction value and the second light quantity correction value.

As described in the present embodiment, the test pattern 171 formed by the exposure with the light quantity corrected based on the first light quantity correction value corresponding to the characteristics of the latent image writing device 7 includes only image density unevenness caused by factors other than the characteristics of the latent image writing device 7. This reduces the image density unevenness in the test pattern and prevents the image density from exceeding the upper limit value as compared with the test pattern formed by exposure with the light amount not corrected by the first exposure correction value. This enables to obtain the image density unevenness in the main scanning direction with high accuracy based on the image density data of the test pattern and calculates the second light quantity correction value with high accuracy. Image formation by exposure with the light quantity corrected based on the light quantity correction value such as the third light quantity correction value calculated based on the first light quantity correction value and the second light quantity correction value decreases the image density unevenness in the main scanning direction and provides good image quality.

Aspect 4

In the aspect 1, the conveyance unit includes a plurality of conveyance members, which are the feed roller 35, the feed relay rollers 41, the registration rollers 49, and the transfer roller 10 in the embodiment, with a predetermined space between a feeding position where the recording medium is fed, that is, a position of the feed roller 35, and a transfer position of the transfer device, and the image forming processor 84 divides the recording medium into a plurality of sections in the conveyance direction of the recording medium based on the length L of the recording medium in the conveyance direction of the recording medium and recording medium conveyance distances between the plurality of conveyance members, which are a conveyance distance L6 from the feed roller 35 to the feed relay rollers 41, a conveyance distance L5 form the feed relay rollers 41 to the registration rollers 49, and a conveyance distance L4 form the registration rollers 49 to the transfer roller 10, and sets the position of the test pattern in a longest section in the conveyance direction of the plurality of sections.

As described using FIG. 17, this enables to create the test pattern avoiding the positions where the shock jitter that occurs when the trailing edge of the sheet S in the conveyance direction of the recording medium, that is the sub-scanning direction, passes through the conveyance members, which are the feed roller 35, the feed relay rollers 41, and the registration rollers 49 in the embodiment, and make the length of the test pattern in the conveyance direction of the recording medium as long as possible.

Aspect 5

In the aspect 1, the conveyance unit includes a plurality of conveyance members, which are the transfer roller 10, the fixing roller 44*a*, the ejection relay rollers 43 and the ejection rollers 46 in the embodiment, with a predetermined space between the transfer position of the transfer device and an ejection position where the recording medium is ejected, that is the position of the ejection rollers 46, to an outside of the image forming apparatus, and the image forming processor 84 divides the recording medium into a plurality of sections in the conveyance direction of the recording medium based on the length L of the recording medium in the conveyance direction of the recording medium and recording medium conveyance distances between the plurality of conveyance members, which are a conveyance distance L3 from the transfer roller 10 to the fixing roller 44*a*, a conveyance distance L2 from the fixing roller 44*a* to the ejection relay rollers 43, and a conveyance distance L1 form the ejection relay rollers 43 to the ejection roller 16, and sets the position of the test pattern in a longest section in the conveyance direction of the plurality of sections.

As described using FIG. 18, this enables to create the test pattern avoiding the locations of the shock jitter that occur when the leading edge of the sheet S in the conveyance direction of the recording medium, that is the sub-scanning direction, enters the conveyance members, which are the fixing roller 44*a*, the ejection relay rollers 43, and the ejection rollers 46 in the embodiment, and make the length of the test pattern in the conveyance direction of the recording medium as long as possible.

Aspect 6

In the aspect 1, the conveyance unit includes a plurality of conveyance members, which are the feed roller 35, the feed relay rollers 41, the registration rollers 49, the transfer roller 10, the fixing roller 44*a*, the ejection relay rollers 43 and the ejection rollers 46 in the embodiment, with a predetermined space between a feeding position where the recording medium is fed and an ejection position where the recording medium is ejected to an outside of the image forming apparatus, and the image forming processor 84 divides the recording medium into a plurality of sections in the conveyance direction of the recording medium based on the length L of the recording medium in the conveyance direction of the recording medium and a recording medium conveyance distance between the plurality of conveyance members, which is a conveyance distance L6 from the feed roller 35 to the feed relay rollers 41, a conveyance distance L5 form the feed relay rollers 41 to the registration rollers 49, and a conveyance distance L4 form the registration rollers 49 to the transfer roller 10, the conveyance distance L3 from the transfer roller 10 to the fixing roller 44*a*, the conveyance distance L2 from the fixing roller 44*a* to the ejection relay rollers 43, and the conveyance distance L1 from the ejection relay rollers 43 to the ejection roller 16, and sets the position of the test pattern in a longest section in the conveyance direction of the plurality of sections.

As described using FIG. 19, this enables to create the test pattern avoiding the locations of the shock jitter that occur when the leading edge of the sheet S in the conveyance direction of the recording medium enters the conveyance members, which are the fixing roller 44*a*, the ejection relay rollers 43, and the ejection rollers 46 in the embodiment, and the shock jitter that occurs when the trailing edge of the sheet S in the conveyance direction of the recording medium pass through the conveyance members, which are the feed roller 35, the feed relay rollers 41, and the registration rollers 49 in the embodiment, and make the length of the test pattern in the conveyance direction of the recording medium as long as possible.

Aspect 7

In the aspect 1, the length in the main scanning direction of the recording medium to form the test pattern is the maximum size in the main scanning direction in which the image forming apparatus can form an image.

As described in the embodiment, this enables formation of the test pattern 171 as long as possible and corrects the image density unevenness at ends in the main scanning direction.

Aspect 8

In any one of the aspect 4 to the aspect 6, the image forming processor 84 sets a length of the test pattern 171 in the conveyance direction of the recording medium to be equal to or shorter than a length in the conveyance direction of the recording medium of the section having the longest length in the conveyance direction of the recording medium.

As described in the embodiment, this setting prevents the test pattern 171 from crossing the position of the shock jitter and appearance of the shock jitter in the test pattern 171.

Numerous additional modifications and variations are possible considering the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. An image forming apparatus comprising:

a latent image bearer;

a latent image writing device that exposes a surface of the latent image bearer to form a latent image on the latent image bearer, wherein the latent image writing device includes a plurality of light emitting elements aligned in a main scanning direction and disposed facing the surface of the latent image bearer;

a memory configured to store a pre-determined first light quantity correction value that normalizes an optical output of the light emitting elements;

a developing device to develop the latent image;

a conveyance unit to convey a recording medium;

a transfer device to transfer an image developed by the developing device from the latent image bearer onto the recording medium;

a length data acquisition unit to obtain a length of the recording medium in a conveyance direction of the recording medium set in the image forming apparatus;

an image forming processor to form a test pattern by setting a length of the test pattern in a sub-scanning direction and a position on which the test pattern is formed on the recording medium based on a distance from a transfer position of an image to a position at which a shock occurs when a leading edge of a sheet enters and a distance from the transfer position of the image to a position at which a shock occurs when a trailing edge of the sheet passes through; and a light quantity correction calculator that corrects a light quantity with which the latent image writing device exposes the surface of the latent image bearer based on the first pre-determined light quantity correction value, acquires image density data of the test pattern formed on the recording medium, and calculates a second light quantity correction value to correct the light quantity with which the latent image writing device exposes the surface of the latent image bearer based on the acquired image density data.

2. The image forming apparatus according to claim 1, wherein the light quantity correction calculator calculates a third light quantity correction value based on the pre-determined first light quantity correction value and the second light quantity correction value, and corrects the light quantity with which the latent image writing device exposes the surface of the latent image bearer based on the third light quantity correction value.

3. The image forming apparatus according to claim 1, wherein the conveyance unit includes a plurality of conveyance members positioned with a predetermined space between a feeding position from which the recording medium is fed and a transfer position of the transfer device, and wherein the image forming processor divides the recording medium into a plurality of sections of different lengths in the conveyance direction of the recording medium based on the length of the recording medium in the conveyance direction of the recording medium and a recording medium conveyance distance between the plurality of conveyance members, and sets the position of the test pattern in a longest section in the conveyance direction of the plurality of sections.

4. The image forming apparatus according to claim 1, wherein the conveyance unit includes a plurality of conveyance members positioned with a predetermined space between the transfer position of the transfer device and an ejection position from which the recording medium is ejected to an outside of the image forming apparatus, and wherein the image forming processor divides the recording medium into a plurality of sections of different lengths in the conveyance direction of the recording medium based on the length of the recording medium in the conveyance direction of the recording medium and a recording medium conveyance distance between the plurality of conveyance members, and sets the position of the test pattern in a longest section in the conveyance direction of the plurality of sections.

5. The image forming apparatus according to claim 1, wherein the conveyance unit includes a plurality of conveyance members positioned with a predetermined space between a feeding position from which the recording medium is fed and an ejection position from which the recording medium is ejected to an outside of the image forming apparatus, and wherein the image forming processor divides the recording medium into a plurality of sections in the conveyance direction of the recording medium based on the length of the recording medium in the conveyance direction of the recording medium and a recording medium conveyance distance between the plurality of conveyance members and sets the position of the test pattern in a longest section in the conveyance direction of the plurality of sections.

6. The image forming apparatus according to claim 1, wherein a length in a main scanning direction of the recording medium on which the test pattern is formed is a maximum size in the main scanning direction in which the image forming apparatus can form an image.

7. The image forming apparatus according to claim 3, wherein the image forming processor sets a length of the test pattern in the conveyance direction of the recording medium to be equal to or shorter than a length in the conveyance direction of the recording medium of a section having the longest length in the conveyance direction of the recording medium.

8. The image forming apparatus according to claim 4, wherein the image forming processor sets a length of the test pattern in the conveyance direction of the recording medium to be equal to or shorter than a length in the conveyance direction of the recording medium of a section having the longest length in the conveyance direction of the recording medium.

9. The image forming apparatus according to claim 5, wherein the image forming processor sets a length of the test pattern in the conveyance direction of the recording medium to be equal to or shorter than a length in the conveyance direction of the recording medium of a section having the longest length in the conveyance direction of the recording medium.

10. An image forming method for an image forming apparatus, the image forming apparatus including a latent image writing device that exposes a surface of a latent image bearer to form a latent image on the latent image bearer, wherein the latent image writing device includes a plurality of light emitting elements aligned in a main scanning direction and disposed facing the surface of the latent image bearer, the method comprising, obtaining a length of a recording medium in a conveyance direction of the recording medium set in the image forming apparatus that forms a test pattern on the recording medium;

setting a length of a test pattern in a sub-scanning direction and a position on which the test pattern is formed on the recording medium based on a distance from a transfer position of an image to a position at which a shock occurs when a leading edge of a sheet enters and a distance from the transfer position of the image to a position at which a shock occurs when a trailing edge of the sheet passes through;

obtaining a pre-determined first light quantity correction value that normalized an optical output of the light emitting elements;

forming the test pattern using the latent image writing device based on the position of the test pattern, the test pattern length in the conveyance direction of the recording medium, and the pre-determine first light quantity correction value;

acquiring image density data of the test pattern formed on the recording medium;

calculating a second light quantity correction value to correct a light quantity with which the latent image writing device exposes the surface of the latent image bearer based on the image density data acquired; and forming an image using the light quantity corrected by the second light quantity correction value.

11. A non-transitory computer-readable recording medium with an executable program stored thereon, wherein the program, when executed, instructs an image forming apparatus that including a latent image writing device that exposes a surface of a latent image bearer to form a latent image on the latent image bearer, wherein the latent image writing device includes a plurality of light emitting elements aligned in a main scanning direction and disposed facing the surface of the latent image bearer, to execute an image forming method comprising:

obtaining a length of a recording medium in a conveyance direction of the recording medium set in the image forming apparatus that forms a test pattern on the recording medium;

setting a length of a test pattern in a sub-scanning direction and a position on which the test pattern is formed on the recording medium based on a distance from a transfer position of an image to a position at which a shock occurs when a leading edge of a sheet enters and a distance from the transfer position of the image to a position at which a shock occurs when a trailing edge of the sheet passes through;

obtaining a pre-determined first light quantity correction value that normalizes an optical output of the light emitting elements;

forming the test pattern using the latent image writing device based on the position of the test pattern, the test pattern length in the conveyance direction of the recording medium, and the pre-determined first light quantity correction value;

acquiring image density data of the test pattern formed on the recording medium;

calculating a second light quantity correction value to correct a light quantity with which the latent image writing device exposes the surface of the latent image bearer based on the image density data acquired; and forming an image using the light quantity corrected by the second light quantity correction value.

* * * * *